US007022450B2

(12) United States Patent
Asano et al.

(10) Patent No.: US 7,022,450 B2
(45) Date of Patent: Apr. 4, 2006

(54) IMAGE FORMING METHOD AND IMAGE FORMING APPARATUS

(75) Inventors: Masao Asano, Tokyo (JP); Hiroshi Yamazaki, Hachioji (JP); Shigeki Takenouchi, Chofu (JP); Akihiko Itami, Hachioji (JP); Satoshi Uchino, Hachioji (JP)

(73) Assignee: Konica Corporation (JP)

( * ) Notice: Subject to any disclaimer, the term of this patent is extended or adjusted under 35 U.S.C. 154(b) by 310 days.

(21) Appl. No.: 10/376,733

(22) Filed: Feb. 28, 2003

(65) Prior Publication Data

US 2003/0180646 A1 Sep. 25, 2003

(30) Foreign Application Priority Data

Mar. 5, 2002 (JP) ..... 2002-058673
Mar. 27, 2002 (JP) ..... 2002-088395

(51) Int. Cl.
*G03G 15/16* (2006.01)

(52) U.S. Cl. ..... 430/126; 399/346

(58) Field of Classification Search ..... 399/346; 430/124, 126, 110.3, 66
See application file for complete search history.

(56) References Cited

U.S. PATENT DOCUMENTS 4,411,977 A * 10/1983 Tarumi et al. ..... 430/126
5,242,776 A * 9/1993 Doi et al. ..... 430/66
6,363,237 B1 * 3/2002 Nagame et al. ..... 399/343
6,479,202 B1 * 11/2002 Shida et al. ..... 430/66
6,562,529 B1 * 5/2003 Kojima et al. ..... 399/346
6,686,114 B1 * 2/2004 Sakon et al. ..... 399/346
2002/0037469 A1 * 3/2002 Kohyama et al. ..... 430/110.3

FOREIGN PATENT DOCUMENTS

| | | |
|---|---|---|
| JP | 5181291 | 7/1993 |
| JP | 6332324 | 12/1994 |
| JP | 6337598 | 12/1994 |
| JP | 7271142 | 10/1995 |
| JP | 08202226 A * | 8/1996 |
| JP | 6356658 | 3/1998 |

* cited by examiner

*Primary Examiner*—Christopher RoDee
(74) *Attorney, Agent, or Firm*—Muserlian, Lucas and Mercanti

(57) ABSTRACT

An electrophotographic image forming method is disclosed. A latent image on a photoreceptor is developed to form a toner image on the photoreceptor by a developer and the toner image is transferred to a recording material or an intermediate transfer element, and the developing and the transferring are performed while regulating a contact angle of the photoreceptor with water within ±5° of an average contact angle by applying a surface energy-lowering agent on the surface of the photoreceptor.

19 Claims, 6 Drawing Sheets

TONER HAVING NO CORNERS

TONER HAVING CORNERS

TONER HAVING CORNERS

IMAGE FORMING METHOD AND IMAGE FORMING APPARATUS

FIELD OF THE INVENTION

The present invention relates to an image forming method and an image forming apparatus utilized in such as a copying machine, a printer and a facsimile.

BACKGROUND OF THE INVENTION

Heretofore, as a method of transferring a toner image on an electrophotographic photoreceptor (hereinafter, also referred as a photoreceptor) onto a recording material of a final image, well known is a method in which a toner image on an electrophotographic photoreceptor is directly transferred to a recording material. On the other hand, well known is an image forming method utilizing an intermediate transfer element; the method provided with another transfer process in the process of transferring a toner image from a photoreceptor to a recording material, and after a toner image being primarily transferred from a photoreceptor to an intermediate transfer element, a final image is obtained by transferring the primary transferred image on an intermediate transfer element to a recording material. Among them, the aforementioned intermediate transfer method is generally applied as an overlapping transfer method of each color toner image in a so-called full color image forming apparatus, in which a color separated original image is reproduced by means of subtractive mixing using such as black, cyan, magenta and yellow toners.

However, in either methods described above, in case of performing a copy or print of many sheets, there may be often caused toner filming on a photoreceptor or on an intermediate transfer element, and image defects in a final image due to the increased surface energy of a photoreceptor or an intermediate transfer element, which increases adhesive power thereof with a toner and decreases transfer property of a toner from a photoreceptor to an intermediate transfer element or from an intermediate transfer element to a recording material. Specifically in an image forming method utilizing an intermediate transfer element, decreased transfer property deteriorates the final image quality significantly because the method contains two transfer processes of which one process is a primary transfer means to primarily transfer a toner image from a photoreceptor to an intermediate transfer element and the other process is a secondary transfer means to transfer a toner image from an intermediate transfer element to a recording material.

That is, decrease of transfer property in an image forming method utilizing an intermediate transfer element easily causes so-called hollow characters, in which a part of a toner image is not transferred, and scattered characters.

To improve transfer property, to prevent toner filming or to improve insufficient cleaning, which are responsible for hollow characters and scattered characters, techniques in which fine particles are included in the surface of a photoreceptor to provide roughness on the surface so as to decrease adhesive power of a photoreceptor with a toner to improve transfer property, or to reduce friction power with a blade, having been studied. For example, JP-A 5-181291 (JP-A refers to a Japanese Patent Publication Open to Public Inspection) discloses that alkylsilsesquioxane resin fine particles are included in a photosensitive layer. However, since alkylsilsesquioxane resin fine particles have hygroscopic property to enhance surface wettability of a photoreceptor, that is, to increase surface energy, there causes such problem that transfer property is liable to be depressed. Further, JP-A 63-56658 discloses an electrophotographic photoreceptor including fluorine-contained resin powder to make the surface of a photoreceptor have a low surface energy. However, sufficient surface strength could not be obtained by fluorine-contained resin powder and a problem caused that streak defects were easily produced due to flows on the surface of a photoreceptor.

Further, a technique is disclosed in which a solid lubricant is supplied to an intermediate transfer element and a surface energy of the intermediate transfer element is reduced to improve transfer property of an intermediate transfer element. For example, there are techniques described in such as JP-A 6-337598, 6-332324 and 7-271142. However, it has been found that only to control the surface of an intermediate transfer element is still not sufficient to improve the total transfer property of an image forming method which utilizes an intermediate transfer element provided with two transfer processes, in particular further improvement is required for forming a copy image under high temperature and high humidity or during prolonged operation.

That is, it has been found that in an image forming method utilizing an intermediate transfer element, it is necessary to decrease surface energy of both of a photoreceptor and an intermediate transfer element in suitable balance and to improve the total transfer property of both primary and secondary transfer processes.

SUMMARY OF THE INVENTION

An object of the invention is to provide an image forming method and an image forming apparatus, which overcome problems of conventional techniques such as described above, being improved in transfer property of a toner of an image forming method utilizing an intermediate transfer element, and cause no generation of image defects such as hollow characters and scattered characters.

The invention and its preferable embodiment are described.

An image forming method comprising developing a latent image on a photoreceptor to form a toner image on the photoreceptor by a developer comprising a toner and transferring the toner image onto a recording material or an intermediate transfer element by a transfer means, wherein the developing and the transferring are performed while regulating a contact angle of the photoreceptor with water within ±5° of an average contact angle by applying a surface energy-lowering agent on the surface of the photoreceptor.

In one of the embodiment of the image forming method as described above, the toner image on the photoreceptor is transferred onto the intermediate transfer element, and the transferred image on the intermediate transfer element is transferred onto the recording material.

The average contact angle is preferably from 90 to 120°.

An average surface roughness (Ra) of the surface of a photoreceptor in a 5 μm square measured by use of an inter-atomic power microscope is preferably not less than 1.5 nm and not more than 0.1 μm.

A surface energy-lowering agent is applied by an agent applying means.

A water content of the surface energy-lowering agent is preferably not more than 5.0 weight %.

A surface energy-lowering agent is preferably a metal salt of a fatty acid.

The metal salt of a fatty acid is preferably zinc stearate.

The surface layer of the photoreceptor preferably contains fine particles having a number average particle diameter of from 5 to 500 nm.

A shape coefficient of toner particles utilized is preferably not more than 16% based on a variation coefficient.

It is preferable to utilize a toner containing not less than 65%, based on number, of a toner having a shape coefficient of from 1.2 to 1.6.

It is preferable to utilize a toner containing not less than 50%, based on number, of a toner having no corners.

It is preferable to utilize a toner having not less than 70% of a sum (M) of a relative frequency ($m_1$) of a toner included in the most frequent class and a relative frequency ($m_2$) of a toner included in the next frequent class, based on a histogram showing a particle size distribution based on number, in which natural logarithm lnD is abscissa being divided into plural classes at 0.23 intervals when a particle diameter of a toner is D (μm).

In an image forming method which converts a latent image on a photoreceptor into a toner image by a development means and provided with a transfer process to transfer the toner image onto a recording material or an intermediate transfer element, it is preferable that a toner having a coefficient of number variation of not more than 27% is utilized while applying a surface energy-lowering agent having a water content of not more than 5 weight % onto the surface of the photoreceptor.

A surface energy-lowering agent is preferably a fluorine-contained resin containing a fluorine atom.

A toner is preferably a polymerized toner.

A number average particle diameter of a toner is preferably from 3.0 to 8.5 μm.

A ten-point surface roughness (Rz) of the photoreceptor is preferably from 0.05 to 4.0 μm.

Fine particles having a number average particle diameter of from 5 nm to 8 μm are preferably included in a surface layer of a photoreceptor.

A cross-sectional view of a color image forming apparatus showing an embodiment of the invention,

FIG. 2

An example of a cleaning means for an intermediate transfer element,

FIG. 3

A schematic view of a positional relationship of a photoreceptor, an endless belt-form intermediate transfer element and a primary transfer roller,

FIG. 4

A schematic view of a positional relationship of a back-up roller, an endless belt-form intermediate transfer element and a secondary transfer roller,

FIG. 5

Figure 6:
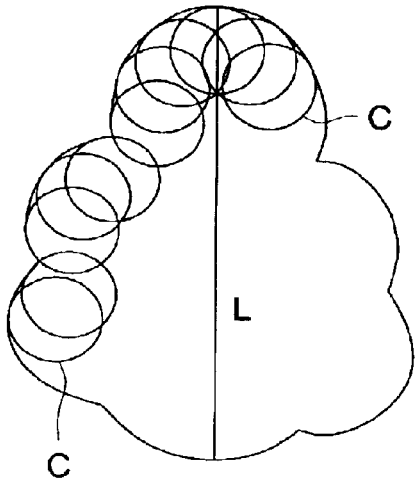
Figure 6:
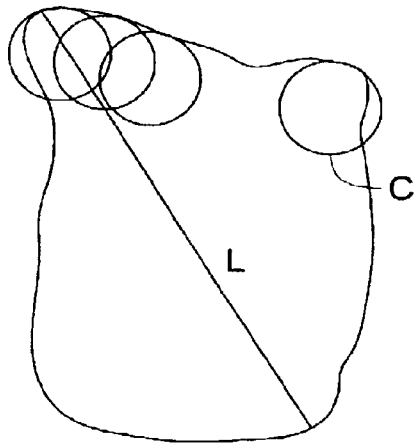
Figure 6:
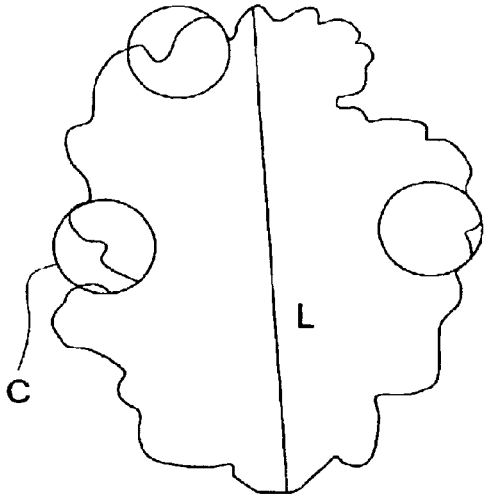

A constitutional view of a cleaning means mounted on a photoreceptor of the invention, FIG. 6(*a*) is explanatory drawing showing a projected image of a corner-less toner particle, and FIGS. 6(*b*) and (*c*) are, respectively, explanatory drawings showing a projected image of a toner particle having corners,

FIG. 7

A perspective view of an example of a polymer toner reaction apparatus,

FIG. 8

Figure 9:
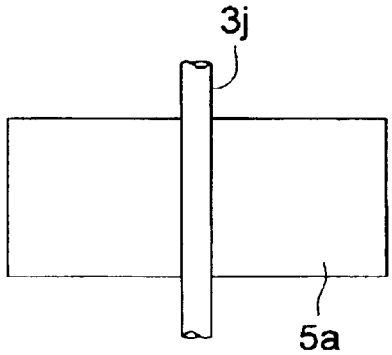
Figure 9:
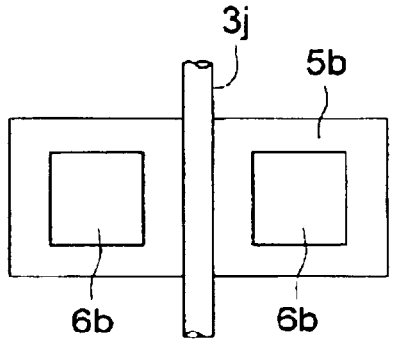
Figure 9:
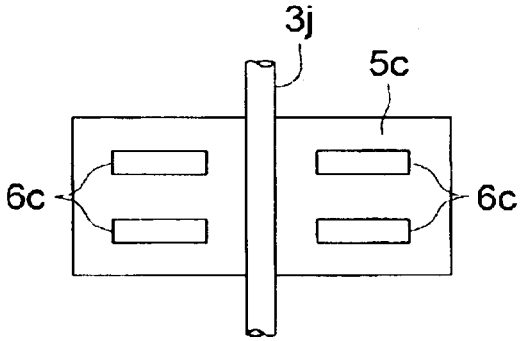
Figure 9:
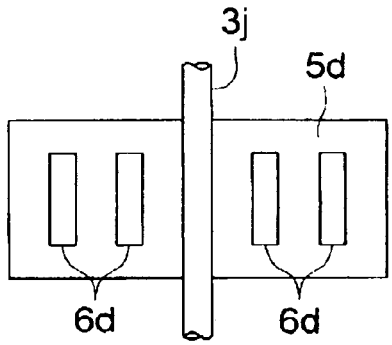

A cross-sectional view of an example of a polymer toner reaction apparatus,

FIGS. 9(*a*), (*b*), (*c*) and (*d*)

A schematic view of a concrete example of a shape of a stirring fan.

DETAILED DESCRIPTION OF THE INVENTION

The invention will be detailed below.

Figure 1:
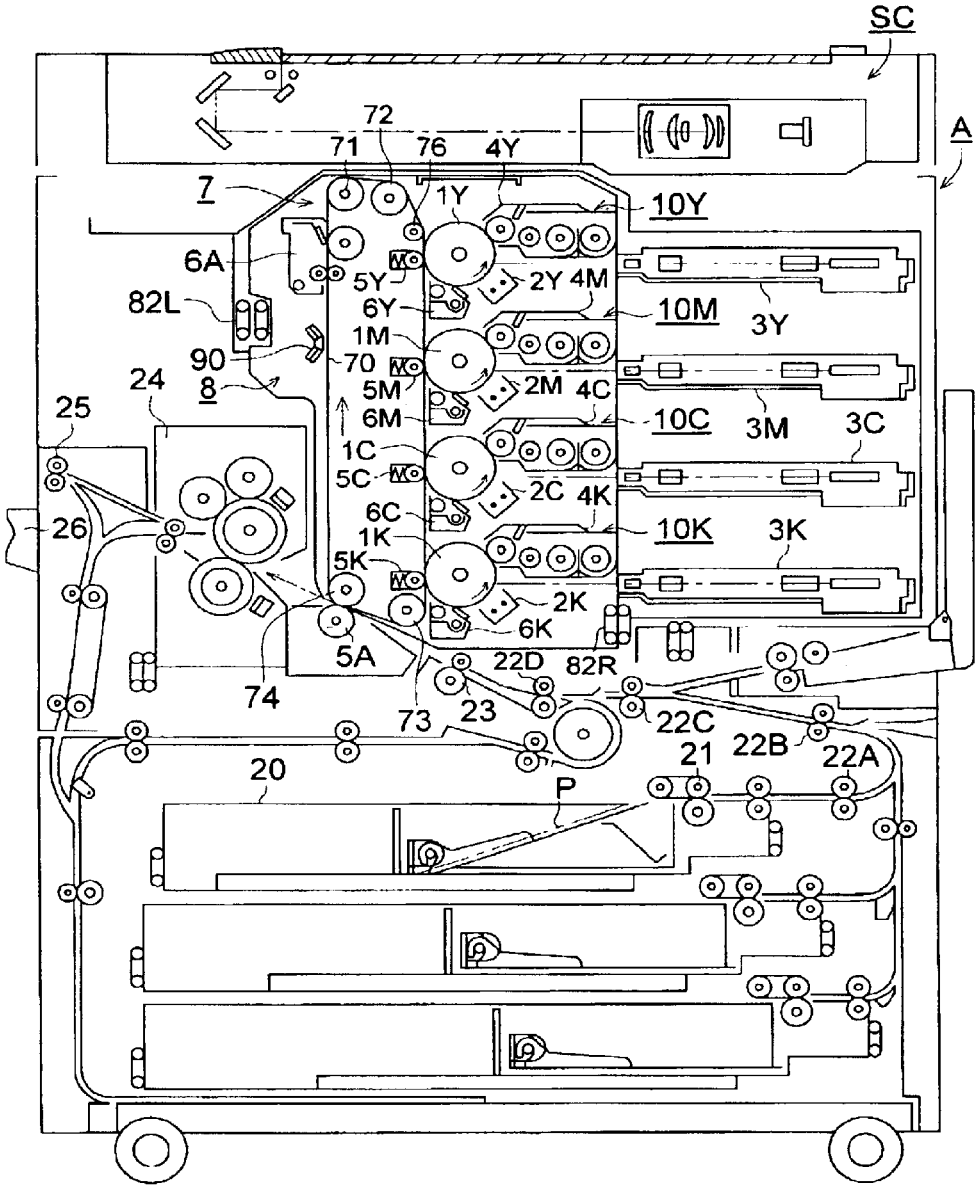
FIG. 1

FIG. 1 is a cross-sectional constitution drawing of a color image forming apparatus showing an exemplary embodiment of the invention.

The color image forming apparatus is called as a tandem type color image forming apparatus and is comprised of plural sets of color image forming portions 10Y, 10M, 10C and 10K; endless belt-form intermediate transfer element unit 7; paper supply and transport means 21; and fixing means 24. Original image reading device SC is mounted on the head of main body A of an image forming apparatus.

Image forming portion 10Y, at which an image of yellow color is formed, is comprised of electric charging means 2Y, exposure means 3Y, development means 4Y, primary transfer roller 5Y as a primary transfer means and cleaning means 6Y, which are arranged at the surroundings of drum-form photoreceptor 1Y as the first image carrier. Image forming portion 10M, at which an image of magenta color is formed, is comprised of drum-form photoreceptor 1M as the first image carrier, electric charging means 2M, exposure means 3M, development means 4M, primary transfer roller 5M as a primary transfer means and cleaning means 6M. Image forming portion 10C, at which an image of cyan color is formed, is comprised of drum-form photoreceptor 1C as the first image carrier, electric charging means 2C, exposure means 3C, development means 4C, primary transfer roller 5C as a primary transfer means and cleaning means 6C. Image forming portion 10K, at which an image of black color is formed, is comprised of drum-form photoreceptor 1K as the first image carrier, electric charging means 2K, exposure means 3K, development means 4K, primary transfer roller 5K as a primary transfer means and cleaning means 6K.

Endless belt-form intermediate transfer element unit 7 is provided with endless belt-form transfer element 70 as a second image carrier of semi-conductive endless belt-form which is wound and held rotatable around plural rollers.

Each color image formed at image forming portions 10Y, 10M, 10C and 10K is transferred successively onto rotating endless belt-form intermediate transfer element 70 to form a synthesized color image. Paper P as a recording material (a support carrying a fixed final image: for example, a plain paper, a transparent sheet, etc.) stored in paper supply cassette 20 is supplied through paper supply means 21 followed by being transported through plural intermediate rollers 22A, 22B, 22C and 22D and register roller 23 to secondary transfer roller SA as a secondary transfer means; and a color image is transferred collectively by a secondary transfer process on paper P. Paper P on which a color image has been transferred is subjected to a fixing treatment by fixing means 24, and is nipped by paper ejecting roller 25 to be placed on paper ejecting tray 26 outside of a machine.

On the other hand, endless belt-form intermediate transfer element 70, which is separated by curvature from paper P, is erased of a residual toner by cleaning means 6A after a color image is transferred onto paper P by secondary transfer roller 5A as a secondary transfer means.

During an image forming process, primary transfer roller 5K is always brought in pressing contact with photoreceptor 1K. Other primary transfer rollers 5Y, 5M and 5C are brought in pressing contact with corresponding photoreceptors 1Y, 1M and 1C respectively only when a color image is formed.

Secondary transfer roller 5A is press contacted with endless belt-form intermediate transfer element 70 only when a secondary transfer is performed by passing paper P therethrough.

Further, box element 8 is possible to be drew out from apparatus main body A through support rails 82L and 82R.

Box element 8 is constituted of image forming portions 10Y, 10M, 10C and 10K, and endless belt-form intermediate transfer element unit 7.

Image forming portions 10Y, 10M, 10C and 10K are vertically arranged in a column. Endless belt-form intermediate transfer element unit 7 is arranged at the illustrated left side of photoreceptors 1Y, 1M, 1C and 1K. Endless belt-form transfer element unit 7 is constituted of endless belt-form transfer element 70 which is rotatable winding around rollers 71, 72, 73 and 74; primary transfer rollers 5Y, 5M, 5C and 5K; and cleaning means 6A.

Figure 2:
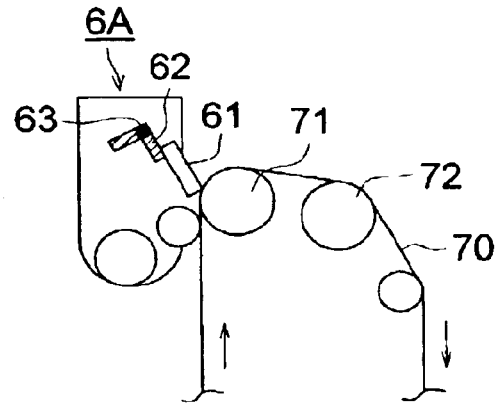

FIG. 2 shows an example of a cleaning means for an intermediate transfer element. A cleaning means for an intermediate transfer element is constituted of blade 61 attached to blanket 62 which is controlled so as to be rotatable around support shaft 63 as shown in FIG. 2, and is possible to adjust the blade pressing pressure against roller 71 by changing spring weight or loading weight.

Image forming portions 10Y, 10M, 10 C and 10K, together with endless belt-form intermediate transfer element unit 7, are drew out as one unit, from main body A by a drawing out operation of box element 8.

Support rail 82L on the illustrated left side of box element 8 is arranged on the left side of endless belt-form intermediate transfer element 70 and in the upper space portion of fixing means 24. Support rail 82R on the illustrated right side of box element 8 is arranged in the neighboring of under lowermost development means 4K. Support rail 82R is arranged at a position where the mounting and dismounting operations of development means 4Y, 4M, 4C and 4K on and from box element 8 is not interfered.

Photoreceptors 1Y, 1M, 1C and 1K in box element 8 are surrounded by development means 4Y, 4M, 4C and 4K at the illustrated right side, by such as electric charging means 2Y, 2M, 2C and 2K and cleaning means 6Y, 6M, 6C and 6K at the illustrated lower side, and by endless belt-form intermediate transfer element 70 at the illustrated left side.

Among them, such as a photoreceptor, a cleaning means and an electric charging means constitute one photoreceptor unit, and such as a development means and a toner supply device constitute one development unit.

Figure 3:
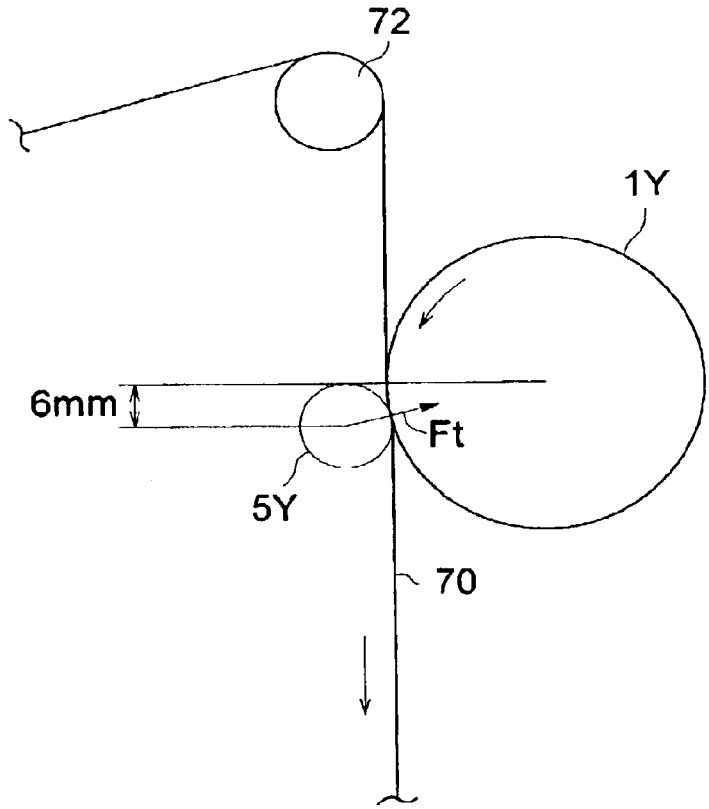

FIG. 3 is an arrangement drawing showing a positional relationship of a photoreceptor, an endless belt-form intermediate transfer element and a primary transfer roller. Primary transfer rollers 5Y, 5M, 5C and 5K are pressed from behind endless belt-form intermediate transfer element 70 as an intermediate transfer element against each photoreceptor 1Y, 1M, 1C and 1K; and primary transfer rollers 5Y, 5M, 5C and 5K are arranged more down-stream, in a rotating direction of a photoreceptor, than the contact point of endless belt-form intermediate transfer element 70 with each photoreceptor 1Y, 1M, 1C and 1K, when they are not in a state of being pressed, and pressed against each photoreceptor 1Y, 1M, 1C and 1K; as is shown in FIG. 3. At this time, in the constitution, endless belt-form transfer element 70 as an intermediate transfer element is bent so as to follow the outer circumference of each photoreceptor 1Y, 1M, 1C and 1K, and primary transfer rollers 5Y, 5M, 5C and 5K are arranged at most down-stream in the contact range of a photoreceptor with endless belt-form intermediate transfer element 70.

Figure 4:
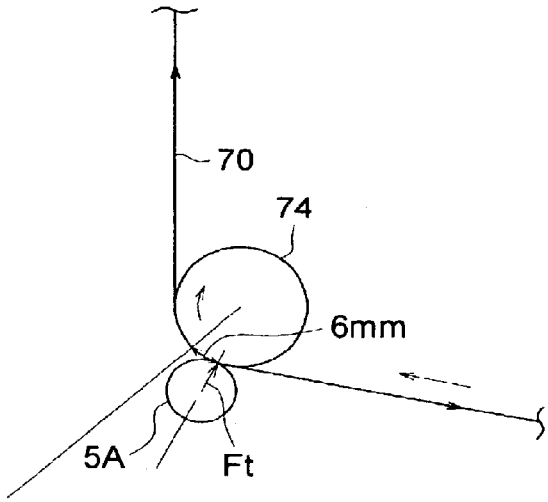

FIG. 4 is an arrangement drawing showing a positional relationship of back-up roller, an endless belt-form transfer element and a secondary transfer roller. Secondary transfer roller 5A is preferably arranged, as is shown in FIG. 4, at upper-stream in a rotating direction of back-up roller 74, than the center of a contact portion of endless belt-form intermediate transfer element 70 as an intermediate transfer element, with back-up roller 74, when they are not in a state of being pressed by secondary transfer roller 5A.

As an intermediate transfer element, utilized are polymer films such as polyimide, polycarbonate and PVdF, synthetic rubbers such as silicone rubber and fluorine-contained rubber, which having been made electric conductive by adding an electric conductive filler such as carbon black; either a drum-form or a belt-form is applicable, however, a belt-form is preferable in respect to latitude in apparatus design.

Further, the surface of an intermediate transfer element is preferably roughened suitably. By setting a ten-point surface roughness Rz of an intermediate transfer element to from 0.5 to 2 μm, a surface energy-lowering agent supplied on a photoreceptor is taken into the surface of an intermediate transfer element, a toner adhesive power on an intermediate transfer element being decreased, and a transfer ratio in a secondary transfer of a toner from an intermediate transfer element to a recording material is easily increased. In this case, the larger is a ten-point surface roughness of an intermediate transfer element than that of a photoreceptor, the larger is tending to be the effect.

Hitherto, the invention was explained according to an image forming apparatus utilizing an intermediate transfer element in FIGS. 1 to 4, however, the invention may be applied to an image forming apparatus in which an image is directly transferred onto a recording material without using an intermediate transfer element.

The invention is characterized in that a latent image on a photoreceptor is developed, while a surface energy-lowering agent is applied on the surface of a photoreceptor, to be visualized as a toner image; wherein as a method to apply a surface energy-lowering agent on the surface of a photoreceptor, is known a method in which a surface energy-lowering agent is mixed in a developer and applied to a photoreceptor from a developer, however, a method different from such a method is preferably utilized in the invention. That is, in case of mixing a surface energy-lowering agent in a developer, it is difficult to achieve a sufficient mixing amount because the mixing affects development characteristics of a toner such as charging property and fluidity, further, in relation to a toner of the invention, preventing effect on generation of hollow characters and scattered characters is easily decreased significantly; therefore a method or means, as described below, different from a method of mixing with a developer is preferably utilized.

That is, the present invention is preferably provided with an agent applying means in which a surface energy-lowering agent is supplied on the surface of a photoreceptor. An agent applying means can be installed at a suitable position in the neighborhood of a photoreceptor, and may be installed utilizing a part of a charging means, developing means or cleaning means which are illustrated in FIG. 1 to effectively make the most of install space. An example will be described below in which an agent applying means is combined with a cleaning means.

Figure 5:
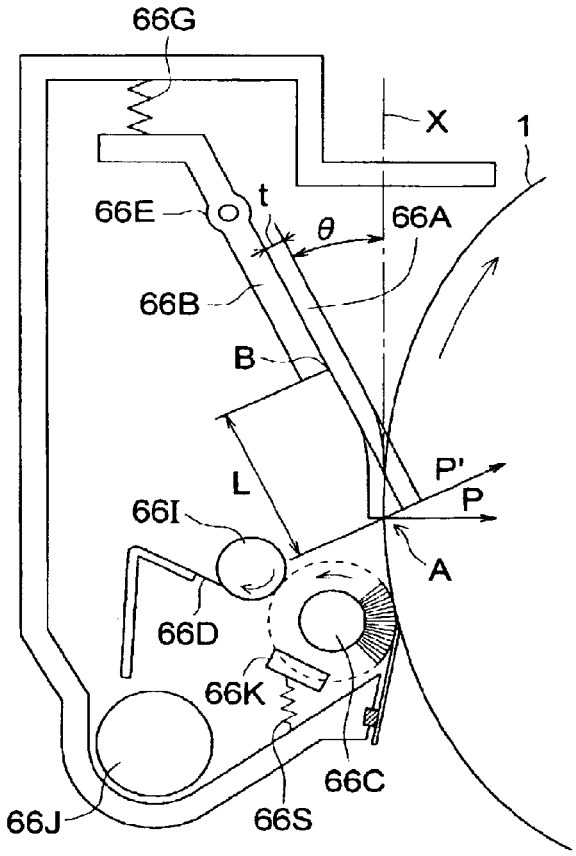

FIG. 5 is a constitutional drawing of a cleaning means mounted on a photoreceptor of the invention. The cleaning means is utilized as a cleaning means of such as 6Y, 6M, 6C and 6K in FIG. 1. Cleaning blade 66A of FIG. 5 is attached to support member 66B. As a material for the cleaning blade, utilized are rubber elastomers, such as urethane rubber, silicone rubber, fluorine-contained rubber, chloroprene rubber and butadiene rubber are well known, and among them specifically preferable is urethane rubber in respect to an excellent abrasion-resistance compared to other rubbers.

On the other hand, support member 66B is constituted by a plate-form metal or plastic members. Preferable metal members are such as a stainless steel plate, an aluminum plate or a damping steel plate.

In the invention, the top edge of a cleaning blade, which is in pressing contact with the surface of a photoreceptor, is preferably brought in pressing contact in a state of weight loaded toward the opposite direction (counter direction) to a rotating direction of a photoreceptor. A top edge of a cleaning blade preferably forms a press contacted surface when it is brought in pressing contact with a photoreceptor, as shown in FIG. 5.

Press contact weight P and contact angle θ of a cleaning blade against a photoreceptor are preferably as follows: P is from 5 to 40 N/m and θ is from 5 to 35°.

Press contact weight P is a vector value in perpendicular direction of press power P' when cleaning blade 66A is in pressing contact with photoreceptor 1.

Further, press contact angle θ represents an angle between a tangent X and a blade before being deformed, at contact point A of a photoreceptor. 66E represents a rotation axis which make a support member rotatable, and 66G represents a load spring.

Further, free length L of the above-described cleaning blade represents, as shown in FIG. 5, a length from the edge B of support member 66B to the top edge of a blade before being deformed. The free length is preferably from 6 to 15 mm, and the thickness of a cleaning blade (t) is preferably from 0.5 to 10 mm. Wherein, a thickness of a cleaning blade is defined, as shown in FIG. 5, a perpendicular direction to the adhered surface of support member 66B.

In a cleaning means of FIG. 5, utilized is brush roller 66C which serve also as an agent applying means. The brush roller provided with a function as an applying means which supply a surface energy-lowering agent on a photoreceptor together with functions to remove a toner adhered on a photoreceptor and to recover a toner removed by cleaning blade 66A. That is, the brush roller contacts with photoreceptor 1 and rotates in the same direction as the progressing direction of a photoreceptor at the contact portion; thereby, it removes a toner or paper dust on a photoreceptor, as well as conveys the toner removed by cleaning blade 66A to be recovered into convey screw 66J. As pathway during the process, it is preferable to remove removed materials such as a toner which have been transferred from a photoreceptor to brush roller 66C by bringing brush roller 66C in pressing contact with flicker 66I as a removing means. Further, a toner adhered to the flicker is removed by scrubber 66D to recover a toner into convey screw 66J. A toner recovered is taken out of an apparatus as waste or reused by being conveyed through a recycle pipe for reuse (not shown in the figure) to a development device. As materials for flicker 66I, preferably used is a metal pipe such as made of stainless steel or aluminum. On the other hand, as scrubber 66D, utilized are elastic plates such as a phosphor bronze plate, a polyethylene terephthalate plate and polycarbonate plate, and the top edge thereof is preferably brought in pressing contact in a counter-way forming an acute angle against the rotating direction of a flicker.

Further, surface energy-lowering agent 66K (a solid material such as zinc stearate) is attached to a brush roller being pressed by spring load 66S, and the brush abrades, while being rotated, the surface energy-lowering agent to supply it on the surface of a photoreceptor. Although a surface energy-lowering agent is a rectangular solid-shaped in FIG. 5, it may be a circular cylinder-shaped.

A brush roller made of an electric conductive or semi-conductive material is utilized as brush roller 66C.

As a brush constitution material for a brush roller utilized in the invention, arbitrary materials can be used, however, a fiber-forming high polymer which is hydrophobic and has a high dielectric constant is preferably used. Such high polymers include, for example, rayon, nylon, polycarbonate, polyester, methacrylic resin, acrylic resin, polyvinyl chloride, polyvinylidene chloride, polypropylene, polystyrene, polyvinyl acetate, styrene-butadiene copolymer, vinylidene chloride-vinyl acetate copolymer, vinylidene chloride-vinyl acetate-maleic anhydride copolymer, silicone resin, silicone-alkyd resin, phenol formaldehyde resin, styrene-alkyd resin, polyvinyl acetal (e.g., polyvinyl butyral), etc. These binder resins can be utilized alone or in combinations of two or more kinds. Specifically preferable are rayon, nylon, polyester, acrylic resin and polypropylene.

Further, as the brush described above, conductive or semi-conductive one is utilized, and can be utilized one having an arbitrarily adjusted specific resistance by including a substance having a low resistance such as carbon as a constituent material.

The specific resistance of a brush hair of a brush roller is preferably in a range of from $10^1$ to $10^6$ Ωcm, when it is measured under ordinary temperature and humidity (a temperature of 26° C. and a relative humidity of 50%) in a state of an electric voltage of 500 V being applied on the both ends of a brush hair of 10 cm long.

That is, a brush roller is preferably made of a core material such as stainless steel with conductive or semi-conductive brush hair having a specific resistance of $10^1$ to $10^6$ Ωcm. In case of a specific resistance of lower than $10^1$ Ωcm, it is liable to produce such as banding due to discharge; while, in case of higher than $10^6$ Ωcm, it is liable to cause poor cleaning due to a reduced potential difference from a photoreceptor.

The thickness of a brush hair utilized for a brush roller is preferably from 5 to 20 deniers. When it is less than 5 deniers, surface adhered substances unable to be removed due to insufficient abrasion pressure. When it is not less than 20 deniers, a brush becomes rigid to hurt the surface of a photoreceptor as well as to cause abrasion to proceed, resulting in a shortened life of a photoreceptor.

Herein, "denier" is a measured value based on a weight in a gram unit of a 9000 m long brush hair (fiber) constituting the above-described brush.

The density of brush hairs of the brush described above is from $4.5\times10^2/cm^2$ to $2.0\times10^4/cm^2$ (number of brush hairs per one square centimeter). When it is less than $4.5\times10^2/cm^2$, not only rigidity is low and abrasion pressure is weak but also uneven abrasion is caused, which makes uniform removal of adhered substances impossible. When it is not less than $2.0\times10^4/cm^2$, a brush becomes rigid to increase abrasion pressure which abrade a photoreceptor, resulting in generation of image defects such as fog due to reduced sensitivity and black streaks due to abrasion marks.

The intrusion amount of a brush roller into a photoreceptor is preferably adjusted to from 0.4 to 1.5 mm, and more preferably to from 0.5 to 1.2 mm. This intrusion amount means a load, which is generated by relative movement of a photoreceptor and a brush roller and is applied on a brush. From a standpoint of a photoreceptor drum, the load corresponds to abrasion pressure received from a brush, and to regulate the pressure range means that a photoreceptor is necessarily being abraded with appropriate pressure.

The intrusion amount represents an intruding length assuming that brush hairs penetrated linearly into the body without bending at the surface of a photoreceptor when a brush is brought in pressing contact with a photoreceptor.

Since abrasion pressure by a brush at the surface of a photoreceptor is low with a photoreceptor being supplied with a surface energy-lowering agent, it is unable to depress filming of a toner or paper dust on the surface of a photoreceptor when an intrusion amount is not more than 0.4 mm, resulting in generation of defects such as unevenness on a image. On the other hand, when it is not less than 1.5 mm, abrasion amount of a photoreceptor becomes large due to an excess abrasion pressure on the surface of a photoreceptor by a brush, which is problematic because there caused fogging due to a decreased sensitivity or streak defect on a image due to generation of abrasion marks on the surface of a photoreceptor.

As a roll core material for a brush roll used in the invention, mainly utilized are metals such as stainless steel and aluminum; paper, plastic, etc.

A brush roll is preferably constituted by setting a brush on the surface of a cylindrical core material via an adhesive layer.

A brush roll preferably rotates so that the pressing contact portion moves in the same direction as the surface of a photoreceptor. In case that the pressing contact portion moves in the opposite direction, a toner removed by a brush roll may be spilled to contaminate a recording material or an apparatus when an excess toner is present on the surface of a photoreceptor.

When a photoreceptor and a brush roll move in a same direction as described above, the ratio of the both surface velocities is preferably a value within a range between 1 to 1.1 and 1 to 2. When a rotation velocity of a brush roll is slower than a photoreceptor, cleaning failure is liable to occur due to a reduced toner removing ability of a brush roll, while when it is faster than a photoreceptor, blade bounding or turn over is liable to occur due to an excess toner removing ability.

The invention is characterized in that, in an image forming apparatus provided with an intermediate transfer element such as described above, an agent applying means is brought in pressing contact with a photoreceptor to apply a surface energy-lowering agent having a water content of not more than 5 weight % on the surface of a photoreceptor.

Wherein, a surface energy-lowering agent refers to a material which adheres to the surface of a photoreceptor and lowers a surface energy, and specifically a material which increases a contact angle (a contact angle against pure water) of the surface of a photoreceptor by not less than 1° by adhering on the surface.

Measurement of Surface Contact Angle

A contact angle of a photoreceptor surface is measured against pure water by use of a contact angle meter (CA-DT•A type: produced by Kyowa Interface Science Co., Ltd.) under environment of 30° C. and 80% RH.

A variation of contact angle is measured under environment of 30° C. and 80% RH. The measurement is performed when a photoreceptor is accustomed to image formation and a surface energy-lowering agent is sufficiently applied on the surface of a photoreceptor (for example, after image formation of 1000 sheets). The measurement was performed at a total of 12 points: 4 points of every 90° in a circumferential direction in each of 3 portions, at the center portion and at the portions 5 cm from the left and right edges of a cylindrical photoreceptor; an average value thereof was defined as a contact angle of the invention and a variation was determined from values most distant in plus and minus.

Further, in the invention, the variation of a contact angle of a photoreceptor described above is preferably within ±5°, more preferably within ±4° and most preferably within ±3°. When a variation of a contact angle is over a range of ±5°, it is liable to cause halftone unevenness as well as to cause such as hollow characters and scattered characters.

According to the invention, a contact angle is increased by applying a surface energy-lowering agent on the surface of a photoreceptor, and the contact angle is preferably in a range of from 90 to 120°. When it is less than 90°, effect to prevent hollow characters and scattered characters is small; when it is not less than 120°, disadvantages other than a variation of a contact angle are liable to become significant. That is, suitable materials are hardly found as a surface energy-lowering agent which makes a contact angle not less than 120°, and an electrophotographic image is liable to suffer from deterioration by adding such a material to a photoreceptor.

A surface energy-lowering agent includes a metal salt of fatty acid or a fluorine-contained resin, and these materials are liable to have large water content under conditions of high temperature and high humidity due to hydrophilic groups or impurity components in the materials. When the water content becomes large, the effects of the invention described above are hardly exhibited sufficiently because the surface energy-lowering agent is not uniformly plated on the surface of a photoreceptor. A surface energy-lowering agent utilized in the invention is able to exhibit the effects of the invention sufficiently, by having a water content of not more than 5 weight % under conditions of high temperature and high humidity of 30° C. and 80% RH.

Further, a surface energy-lowering agent is not limited to materials such as a metal salt of fatty acid or a fluoride-contained resin provided that a material increases a contact angle (a contact angle against pure water) of the surface of a photoreceptor by not less than 1°.

A surface energy-lowering agent utilized in the invention is preferably a metal salt of fatty acid as a material which has a spreading property and a film forming ability on the surface of a photoreceptor. A metal salt of fatty acid is preferably a metal salt of saturated or unsaturated fatty acid having not less than 10 carbon atoms. For example, such as aluminum stearate, indium stearate, gallium stearate, zinc stearate, lithium stearate, magnesium stearate, sodium stearate, aluminum palmitate and aluminum oleate are listed, and more preferable is a metal salt of stearic acid.

Among the metal salts of fatty acid described above, particularly a metal salt of fatty acid having a high effusion velocity of a flow tester is able to form a layer of a metal salt of fatty acid more effectively on the foregoing surface of the photoreceptor of the invention because of its high cleavage property. A range of an effusion velocity is preferably not less than $1\times10^{-7}$ and not more than $1\times10^{-1}$ and most preferably not less than $5\times10^{-4}$ and not more than $1\times10^{-2}$. An effusion velocity of a flow tester is measured by use of Shimadzu Flow Tester CFT-500 (produced by Shimadzu Corp.).

Further, as other examples of the solid material described above preferable are fluorine-contained resin powder such as polyvinylidene fluoride and polytetrafluoroethylene. These solid materials are preferably utilized by being made into a plate-shape or a bar-shape by applying pressure when necessary.

Herein, measurement of a water content is performed, in case of a surface energy-lowering agent, by charging the material in a shallow glass vessel and after being kept at 30° C. and 80% RH for 24 hours, by use of Karl Fischer's water content meter (produced by Kyoto Electronics Manufacturing Co., Ltd.; MKA-3p).

A method to make a water content of a surface energy-lowering agent not more than 5 weight % is achieved by decrease of a water content under a condition of high temperature and high humidity (30° C. and 80% RH) which is made possible by controlling hydrophilic components or impurities in the material, for example, by purification or hydrophobicity treatment; as well as by mixing of a water content controlling agent; or by high temperature drying treatment at not lower than 100° C. The water content described above is preferably from 0.01 to 5.0 weight % and more preferably from 0.05 to 3.0 weight %, to minimize dependence on environmental variation such as temperature rise during copying, particularly dependence on humidity of a set up place of an image carrying element, to make selection of materials and hydrophobicity treatment easy, and to prevent hollow characters and scattered characters.

Microscopically, the surface of a photoreceptor in the invention is preferably provided with a much smaller roughness compared to a thickness of a photosensitive layer or a size of a toner. That is, according to the invention, by supplying a surface energy-lowering agent having a small water content on the surface of a photoreceptor which is provided with a surface layer having a average surface roughness in 5 μm square (Ra), measured by use of an inter atomic power microscope, of not less than 1.5 nm and not more than 0.1 μm, forming a thin layer of a surface energy-lowering agent effectively on the surface of a photoreceptor and decreasing a variation of a contact angle dependence on the positions; generation of scattered characters or hollow characters can be prevented and an electrophotographic image of excellent sharpness can be obtained.

A concrete means to realize a photoreceptor which is provided with a surface layer having a average surface roughness in 5 μm square (Ra), measured by use of an inter-atomic power microscope, of not less than 1.5 nm and not more than 0.1 μm, will be described below.

A surface roughness of a photoreceptor of the invention is measured by use of an inter-atomic power microscope. The measurement method will be explained below.

Inter-atomic power microscope (AMF): scanning type probe microscope SPI3800N, multi-functional unit SPA400 (produced by Seiko Instruments Co., Ltd.), Measurement mode: dynamic force mode (DFM mode), Sensor lever: SI-DF20 (made of silicone having a spring constant of 20 N/m, a characteristic frequency of 135 kHz)

Measurement area: 5×5 μm

The aforementioned DFM mode is a mode in which a sensor lever is vibrated at a certain frequency (a frequency characteristic to the sensor lever), being intermittently contacted with an approaching sample and a shape of the surface is expressed by a decrease of vibration amplitude. In the DMF mode, since measurement is performed in contactless with the surface of a photoreceptor, the surface of a photoreceptor is never hurt and the measurement can be performed while keeping the original shape of the samples.

Average surface roughness (Ra): represents a center line roughness Ra defined in JIS B601 was extended to three-dimension so that it can be applicable to a measured plane, and is "a value averaging absolute values of a deviation from a standard plane to a specified plane", being expressed by the following equation.

$$Ra = 1/S_0 \int_0^Y \int_0^X |F(X, Y) - Z_0|\, dX\, dY$$

A specified plane is an entire measurement plane and, in the invention, represents a measurement plane (XY plane) of 5 μm square.

Entire measurement plane Z is determined according to the following equation:

$$Z=F(X, Y)$$

$S_0$ is determined by the following equation:

$$S_0=X\times Y$$

Standard plane: a plane represented by $Z=Z_0$, wherein average of Z is $Z_0$ $Z_0$ is obtained by the following equation:

$$Z_0 = 1/S_0 \int_0^Y \int_0^X |F(X, Y) - Z_0|\, dX\, dY$$

Next, a constitution of a photoreceptor having such a surface shape will be described.

Fine particles having a number average particle diameter of from 5 to 500 nm are preferably added in a surface layer of a photoreceptor of the invention. A surface layer having a average surface roughness in 5 μm square (Ra), measured by use of an inter-atomic power microscope, of not less than 1.5 nm and not more than 0.1 μm can be prepared, by adding such fine particles described above. The fine particles may be ones such as polyvinylidene fluoride and polytetrafluoroethylene having a function as a surface energy-lowering agent, however, a surface roughness is preferably adjusted by incorporating inorganic fine particles (for example, described in JP-A 8-248663), which have a mean number average particle diameter of from 5 to 500 nm and having been treated to be made hydrophobic, being dispersed in a surface layer of a photoreceptor. Further, as a method to make inorganic fine particles hydrophobic, a method, in which they are treated by a processing agent providing hydrophobicity such as a titanium coupling agent, a silane coupling agent, a polymeric fatty acid and a metal salt thereof, can be utilized.

Inorganic fine particles include, for example, fine particles of such as silica, titanium oxide, alumina, barium titanate, calcium titanate, strontium titanate, zinc oxide, magnesium oxide, zirconium oxide, barium carbonate, calcium carbonate, silicon carbide, silicon nitride, chromium oxide and red ion oxide.

Macroscopically, a photoreceptor of the invention is preferably has a ten-point surface roughness Rz of from 0.05 to 4.0 μm and more preferably from 0.05 to 2.5 μm. A surface energy-lowering agent is uniformly supplied from an agent applying means onto the surface of a photoreceptor, being developed to form a film uniformly on the surface of a photoreceptor, and a surface energy of a photoreceptor is uniformly lowered without unevenness by setting a ten-point surface roughness of a photoreceptor in the above-described range; whereby, generation of hollow characters and scattered characters as well as deterioration of sharpness can be prevented.

Ten-point surface roughness Rz of a photoreceptor (A definition and a measurement method of ten-point surface roughness Rz)

Rz of the invention means the case of a standard length of 0.25 mm described in JISB 0601-1982, that is, a difference between a mean height of the highest 5 peaks and a mean depth of the lowest 5 bottoms, at distance intervals of a standard length of 0.25 mm.

In the example described below, ten-point surface roughness Rz is measured by a surface roughness meter (Surfcorder SE-30H, produced by Kosaka Laboratory Ltd.). However, other measurement devices may be used provided that they give the same results within an error range.

As a method to adjust ten-point surface roughness Rz of the photoreceptor described above to from 0.05 to 4.0 μm, it is possible by controlling a surface roughness of a support which constitutes a photoreceptor or a surface layer of a photoreceptor. Specifically, a method, in which a surface roughness is controlled by incorporating a various kinds of fine particles in a surface layer constituting a photoreceptor, is effective.

As a method to control ten-point surface roughness Rz of the photoreceptor described above, it is effective to suitably roughen a surface roughness of a conductive support constituting the photoreceptor.

As a material of a conductive support utilized in the invention, mainly used are moldings having a belt-shape or a drum-shape of metal materials such as aluminum, copper, brass, steel and stainless steel, and of other plastic materials. Among them, aluminum being superior in respect to cost and manufacturing is preferably utilized, and an aluminum plain pipe having a thin cylindrical shape generally molded by extrusion or drawing is often used.

A roughened surface state of a conductive support utilized in the invention is preferably not less than 0.1 μm and not over 6.0 μm based on ten-point average surface roughness Rz. More preferably it is not less than 0.2 μm and not more than 5.0 μm. A surface roughness can be controlled by coating the under-coating layer or photosensitive layer, which will be described below, on the support having such a surface roughness.

A method to roughen the surface of a support as described above includes a method in which a support surface is cutting roughened by such as a cutting tool, a sandblast method by clashing fine particles against the support surface, a manufacturing method by use of a washing device by ice-particles described in JP-A 4-204538, and a method of a horning process described in JP-A 9-236937. Further, an anodic oxidation method or Alumite treating method, a buff process method, a method by laser evaporation method described in JP-A 4-233546, a method by polishing tape described in JP-A 8-1502, and a method of roller vanishing process described in JP-A 8-1510 are listed. However, a method to roughen the surface of a support is not limited thereto.

Further, as a method to roughen the surface of a photoreceptor, fine particles having a number average particle diameter of from 0.5 to 8 μm may be added in a surface layer of a photoreceptor of the invention. For example, a ten-point surface roughness of a photoreceptor can be adjusted to the aforementioned range by incorporating fine particles treated to be made hydrophobic as described in JP-A 8-248663 in a surface layer of a photoreceptor. To make inorganic fine particles hydrophobic, a method, in which they are treated by a processing agent providing hydrophobicity such as a titanium coupling agent, a silane coupling agent, a polymeric fatty acid and a metal salt thereof, can be utilized.

As the fine particles described above include organic fine particles such as fine particles of polyacrylate, polymethacrylate, polymethyl methacrylate, polyethylene, polypropylene, polyvinylidene fluoride and polytetrafluoroethylene.

Next, a photoreceptor of the invention will be described.

In the invention, a photoreceptor is an electrophotographic photoreceptor which is utilized for an electrophotographic image formation, and particularly, in case of utilizing an organic electrophotographic photoreceptor (an organic photoreceptor) remarkable effects of the invention are exhibited. An organic photoreceptor means an electrophotographic sensitive element constituted by making an organic compound have at least one of indispensable functions in a constitution of an electrophotographic sensitive element, either of an electric charge generating function or an electric charge transporting function, and includes such as a photoreceptor comprised of a charge generating organic substance or a charge transporting organic substance and a photoreceptor in which a charge generating function and a charge transporting function is made up by a polymer complex.

A surface layer of the invention means a surface layer which exists simply on the surface among various kinds of layers constituting a photoreceptor, and does not indicate a function. That is, in case that a photoreceptor is comprised of accumulating an under-coating layer, a charge generating layer and a charge transport layer in the order, the charge transport layer is a surface layer; and in case that an over-coating layer is further accumulated, the over-coating layer is a surface layer.

The component of the electrographic photoreceptor according to the invention is described below.

Electroconductive Support

A cylindrical electroconductive support is preferably used to make compact the image forming apparatus even though a cylindrical and sheet-shaped support may either be used.

Images can be endlessly formed by the cylindrical electroconductive support. The electroconductive support having a straightness of not more than 0.1 mm and a swing width of not more than 0.1 mm is preferred.

A drum of metal such as aluminum or nickel, a plastic drum on the surface of which aluminum, tin oxide or indium oxide is provided by evaporation, and a plastic and paper drum each coated with an electroconductive substance may be used as the material. The specific electric resistively of the electroconductive support is preferably not more than $10^3$ Ωcm.

The electric conductive support having sealing processed alumite coating at the surface may be employed in the invention. The alumite processing is conducted in acidic bath such as chromic acid, oxalic acid, phosphoric acid, boric acid sulfamic acid etc., and anodic oxidation process in sulfuric acid provides most preferable result. Preferred condition for the anodic oxidation process in sulfuric acid is, for example, sulfuric acid content of 100 to 200 g/l, aluminum ion content of 1 to 10 g/l, bath temperature of around 20° C., and applying voltage of around 20 V. Thickness of the anodic oxidation coating is usually 20 μm or less, particularly 10 μm or less is preferable in average.

Interlayer

In the present invention, an interlayer, functioning as a barrier, may be provided between the electrically conductive support and the photosensitive layer.

In the present invention, an interlayer may be provided between the electrically conductive support and the photosensitive layer for the purpose of improving adhesiveness between the conductive support and the photosensitive layer, or inhibiting the charge penetration from the support.

Listed as an interlayer are materials for the interlayer such as polyamide resin, vinyl chloride resin, vinyl acetate and copolymer resin having two or more repeating unit of these. Polyamide resin, which can minimize the residual potential after repeating use, is preferable. The thickness of the interlayer is preferably between 0.01 and 0.5 μm.

An example of the inter layer employed in the present invention is an inter layer which has hardened metal resin which is obtained by hardening an organic metal compound such as silane coupling agent, titanium coupling agent and so on. The thickness of the inter layer having hardened metallic resin is preferably 0.01 to 2 μm.

Another example is an inter layer which titanium oxide fine particles (an average particle diameter of 0.01 to 1 μm) having subjected to hydrophobic treatment is dispersed in a binder resin such as polyamide resin. The thickness of the inter layer having hardened metallic resin is preferably 1 to 15 μm.

Photosensitive Layer

It is preferable that the photosensitive layer having a charge generation layer CGL and a charge transport layer CTL separated from each other even though a single structure photosensitive layer having both of the charge generation function and the charge transport function may be used. The increasing of the remaining potential accompanied with repetition of the use can be inhibited and another electrophotographic property can be suitably controlled by the separation the functions of the photosensitive layer into the charge generation and the charge transport. In the photoreceptor to be negatively charged, it is preferable that the CGL is provided on a subbing layer and the CTL is further provided on the CGL. In the photoreceptor to be positively charged, the order of the CGL and CTL in the negatively charged photoreceptor is revered. The foregoing photoreceptor to be negatively charged having the function separated structure is most preferable.

The photosensitive layer of the function separated negatively charged photoreceptor is described below.

Charge Generation Layer

Charge generation layer: the charge generation layer contains one or more kinds of charge generation material CGM. Another material such as a binder resin and additive may be contains according to necessity.

Examples of usable CGM include a phthalocyanine pigment, an azo pigment, a perylene pigment and an azulenium pigment. Among them, the CGM having a steric and potential structure capable of taking a stable intermolecular aggregated structure can strongly inhibit the increasing of the remaining potential accompanied with the repetition of use. Concrete examples of such the CGM include a phthalocyanine pigment and a perylene pigment each having a specific crystal structure. For example, a titanyl phthalocyanine having the maximum peak of Bragg angle 2θ of Cu—Kα ray at 27.2° and a benzimidazoleperylene having the maximum peak of Bragg angle 2θ of Cu—Kα ray at 12.4° as the CGM are almost not deteriorated by the repetition of use and the increasing of the remaining potential is small.

A binder can be used in the charge generation layer as the dispersion medium of the CGM. Examples of the most preferable resin include a formal resin, a silicone resin, a silicon-modified butyral resin and a phenoxy resin. The ratio of the binder resin to the charge generation material is from 20 to 600 parts by weight to 100 parts by weight of the binder resin. By the use of such the resin, the increasing of the remaining potential accompanied with the repetition of use can be minimized. The thickness of the charge generation layer is preferably from 0.01 μm to 2 μm.

Charge Transport Layer

Charge transport layer: the charge transport layer is a layer which has a function to transfer charge carrier (an electron or a hole) generated by charge generation material.

The surface layer according to the invention has a charge transport function, and contains a charge transport material CTM of steric isomers mixture and a layer-formable binder resin in which the CTM is dispersed. An additive such as an antioxidant may be further contained according to necessity. The CTM which makes the increase of residual potential during the repeated use as low as possible is those having high mobility and difference of ionization potential between the CTM and CGM used in combination with the CTM of preferably less than 0.5 eV, and more preferably 0.25 eV.

The ionization potential of CGM or CTM was measured employing a surface test apparatus "AC-1" (manufactured by Riken Keiki Co.).

The other charge transport material can be employed in addition to the mixture of the steric isomers mentioned above in combination. For example, a triphenylamine derivative, a hydrazone compound, a styryl compound, a benzyl compound and a butadiene compound may be used as the charge transport material CTM. These charge transport material are usually dissolved in a suitable binder resin to form a layer.

Examples of the resin to be used for charge transport layer CTL include a polystyrene, an acryl resin, a methacryl resin, a vinyl chloride resin, a vinyl acetate resin, a poly (vinyl butyral) resin, an epoxy resin, a polyurethane resin, a phenol resin, a polyester resin, an alkyd resin, a polycarbonate resin, a silicone resin, a melamine resin, a copolymer containing two or more kinds of the repeating unit contained the foregoing resins, and a high molecular weight organic semiconductive material such as poly(N-vinylcarbazole) other than the foregoing insulating resins. The thickness of the charge transport layer is preferably between 10 and 40 μm.

Described next will be the toner which is employed in the present invention. The toner employed in the invention preferably satisfies the following condition.

(1) The variation coefficient of said shape coefficient is not more than 16 percent.
(2) A number ratio of toner particles having a shape coefficient of 1.2 to 1.6 and is at least 65 percent.
(3) A number ratio of toner particles having no corners is 50 percent or more.
(4) A number variation coefficient in the toner number size distribution is not more than 27 percent.
(5) In a number based histogram, in which natural logarithm lnD is taken as the abscissa and said abscissa is divided into a plurality of classes at an interval of 0.23, a toner is preferred, which exhibits at least 70 percent of the sum (M) of the relative frequency ($m_1$) of toner particles included in the highest frequency class, and the relative frequency ($m_2$) of toner particles included in the second highest frequency class. D is diameter of toner particles (in μm).

When the toner satisfying at least one of the above mentioned conditions (1) through (5) is employed in combination with a photoreceptor having surface characteristics according to the invention, generation of image deficiency such as white spots or black spots in the reverse development are inhibited, cleaning characteristics are improved, and therefore, good image is obtained. Particularly the combination of the toner satisfying all of the conditions (1) through (5) and the photoreceptor having specific surface layer, that is, a photoreceptor having charge transport layer containing CTM of a steric isomer mixture as the surface layer improves markedly the incompatible image deficiencies of white spots and black spots.

The condition (1) through (5) to the toner is detailed.

Shape coefficient of toner is a shape coefficient of toner particles, showing roundness of toner particles, which is defined as follows.

$$\text{Shape coefficient}=[(\text{maximum diameter}/2)^2\times\pi]/\text{projection area}$$

wherein the maximum diameter means the maximum width of a toner particle obtained by forming two parallel lines between the projection images of said particle on a plane, while the projection area means the area of the projected image of said toner on a plane.

In the present invention, said shape coefficient was determined in such a manner that toner particles were photographed under a magnification factor of 2,000, employing a scanning type electron microscope, and the resultant photographs were analyzed employing "Scanning Image Analyzer", manufactured by JEOL Ltd. At that time, 100 toner particles were employed and the shape coefficient of the present invention was obtained employing the aforementioned calculation formula.

The polymerized toner of the present invention is that the number ratio of toner particles in the range of said shape coefficient of 1.2 to 1.6 is preferably at least 65 percent and is more preferably at least 70 percent.

By employing a toner having the number ratio of toner particles having a shape coefficient of 1.2 to 1.6 to at least 65 percent in combination with a photoreceptor having surface layer containing CTM of steric isomer mixture as above mentioned, generation of image deficiency such as white spots or black spots in the reverse development are inhibited, cleaning characteristics are improved, and therefore, good image with good sharpness is obtained.

Methods to control said shape coefficient are not particularly limited. For example, a method may be employed wherein a toner, in which the shape coefficient has been adjusted to the range of 1.2 to 1.6, is prepared employing a method in which toner particles are sprayed into a heated air current, a method in which toner particles are subjected to application of repeated mechanical forces employing impact in a gas phase, or a method in which a toner is added to a solvent which does not dissolve said toner and is then subjected to application of a revolving current, and the resultant toner is blended with a toner to obtain suitable characteristics. Further, another preparation method may be employed in which, during the stage of preparing a so-called polymerization method toner, the entire shape is controlled and the toner, in which the shape coefficient has been adjusted to 1.2 to 1.6, is blended with a common toner.

The polymerization toner is preferable in view of simple preparation and excellent uniformity of surface of he toner particles in comparison with the pulverized toner.

The polymerization toner is prepared by formation binder resin for toner particles, polymerization monomer material of binder resin having toner shape, and a chemical process if necessary. More in concrete the toner is prepared by polymerization reaction such as suspension polymerization or emulsion polymerization and fusing process of particles each other thereafter, if necessary. Toner particles having uniform particle distribution and shape are obtained by polymerization toner because the toner is prepared by polymerization after monomer material is dispersed in an aqueous medium uniformly.

The variation coefficient of the polymerized toner is calculated using the formula described below:

$$\text{Variation coefficient}=(S/K)\times 100(\text{in percent})$$

wherein S represents the standard deviation of the shape coefficient of 100 toner particles and K represents the average of said shape coefficient.

Said variation coefficient of the shape coefficient is generally not more than 16 percent, and is preferably not more than 14 percent.

By employing the toner having variation coefficient of the shape coefficient to not more than 16 percent in combination with a photoreceptor having surface layer containing CTM of steric isomer mixture as above mentioned, generation of image deficiency such as white spots or black spots in the reverse development are inhibited, cleaning characteristics are improved, and therefore, good image with good sharpness is obtained.

In order to uniformly control said shape coefficient of toner as well as the variation coefficient of the shape coefficient with minimal fluctuation of production lots, the optimal finishing time of processes may be determined while monitoring the properties of forming toner particles (colored particles) during processes of polymerization, fusion, and shape control of resinous particles (polymer particles).

Monitoring as described herein means that measurement devices are installed in-line, and process conditions are controlled based on measurement results. Namely, a shape measurement device, and the like, is installed in-line. For example, in a polymerization method, toner, which is formed employing association or fusion of resinous particles in water-based media, during processes such as fusion, the shape as well as the particle diameters, is measured while sampling is successively carried out, and the reaction is terminated when the desired shape is obtained.

Monitoring methods are not particularly limited, but it is possible to use a flow system particle image analyzer FPIA-2000 (manufactured by TOA MEDICAL ELECTRONICS CO., LTD.). Said analyzer is suitable because it is possible to monitor the shape upon carrying out image processing in real time, while passing through a sample composition. Namely, monitoring is always carried out while running said sample composition from the reaction location employing a pump and the like, and the shape and the like are measured. The reaction is terminated when the desired shape and the like is obtained.

The number particle distribution as well as the number variation coefficient of the toner of the present invention is measured employing a Coulter Counter TA-11 or a Coulter Multisizer (both manufactured by Coulter Co.). In the present invention, employed was the Coulter Multisizer which was connected to an interface which outputs the particle size distribution (manufactured by Nikkaki), as well as on a personal computer. Employed as used in said Multisizer was one of a 100 μm aperture. The volume and the number of particles having a diameter of at least 2 μm were measured and the size distribution as well as the average particle diameter was calculated. The number particle distribution, as described herein, represents the relative frequency of toner particles with respect to the particle diameter, and the number average particle diameter as described herein expresses the median diameter in the number particle size distribution.

The number variation coefficient in the number particle distribution of toner is calculated employing the formula described below:

$$\text{Number variation coefficient}=(S/D_n)\times 100(\text{in percent})$$

wherein S represents the standard deviation in the number particle size distribution and $D_n$ represents the number average particle diameter (in μm).

The number variation coefficient of the toner of the present invention is not more than 27 percent, and is preferably not more than 25 percent.

By employing a toner having the number variation coefficient to not more than 27 percent in combination with a photoreceptor having surface layer containing CTM of steric isomer mixture as above mentioned, generation of image deficiency such as white spots or black spots in the reverse development are inhibited, cleaning characteristics are improved, and therefore, good image with good sharpness is obtained.

Methods to control the number variation coefficient of the present invention are not particularly limited. For example, employed may be a method in which toner particles are classified employing forced air. However, in order to further decrease the number variation coefficient, classification in liquid is also effective. In said method, by which classification is carried out in a liquid, is one employing a centrifuge so that toner particles are classified in accordance with differences in sedimentation velocity due to differences in the diameter of toner particles, while controlling the frequency of rotation.

Specifically, when a toner is produced employing a suspension polymerization method, in order to adjust the number variation coefficient in the number particle size distribution to not more than 27 percent, a classifying operation may be employed. In the suspension polymerization method, it is preferred that prior to polymerization, polymerizable monomers be dispersed into a water based medium to form oil droplets having the desired size of the toner. Namely, large oil droplets of said polymerizable monomers are subjected to repeated mechanical shearing employing a homomixer, a homogenizer, and the like to decrease the size of oil droplets to approximately the same size of the toner. However, when employing such a mechanical shearing method, the resultant number particle size distribution is broadened. Accordingly, the particle size distribution of the toner, which is obtained by polymerizing the resultant oil droplets, is also broadened. Therefore classifying operation may be employed.

A number ratio of toner particles having no corners is 50 percent or more, and preferably 70 percent of more.

By employing a toner having no corners is 50 percent or more in combination with a photoreceptor having surface layer containing CTM of steric isomer mixture as above mentioned, generation of image deficiency such as white spots or black spots in the reverse development are inhibited, cleaning characteristics are improved, and therefore, good image with good sharpness is obtained.

The toner particles of the present invention, which substantially have no corners, as described herein, mean those having no projection to which charges are concentrated or which tend to be worn down by stress. Namely, as shown in FIG. 6(*a*), the main axis of toner particle T is designated as L. Circle C having a radius of L/10, which is positioned in toner T, is rolled along the periphery of toner T, while remaining in contact with the circumference at any point. When it is possible to roll any part of said circle without substantially crossing over the circumference of toner T, a toner is designated as "a toner having no corners". "Without substantially crossing over the circumference" as described herein means that there is at most one projection at which any part of the rolled circle crosses over the circumference. Further, "the main axis of a toner particle" as described herein means the maximum width of said toner particle when the projection image of said toner particle onto a flat plane is placed between two parallel lines. Incidentally, FIGS. 6(*b*) and 6(*c*) show the projection images of a toner particle having corners.

Toner having no corners is measured as follows. First, an image of a magnified toner particle is made employing a scanning type electron microscope. The resultant picture of the toner particle is further magnified to obtain a photographic image at a magnification factor of 15,000. Subsequently, employing the resultant photographic image, the presence and absence of said corners is determined. Said measurement is carried out for 100 toner particles.

Methods to obtain toner having no corners are not particularly limited. For example, as previously described as the method to control the shape coefficient, it is possible to obtain toner having no corners by employing a method in which toner particles are sprayed into a heated air current, a method in which toner particles are subjected to application of repeated mechanical force, employing impact force in a gas phase, or a method in which a toner is added to a solvent which does not dissolve said toner and which is then subjected to application of revolving current.

Further, in a polymerized toner which is formed by associating or fusing resinous particles, during the fusion terminating stage, the fused particle surface is markedly uneven and has not been smoothed. However, by optimizing conditions such as temperature, rotation frequency of impeller, the stirring time, and the like, during the shape controlling process, toner particles having no corners can be obtained. These conditions vary depending on the physical properties of the resinous particles. For example, by setting the temperature higher than the glass transition point of said resinous particles, as well as employing a higher rotation frequency, the surface is smoothed. Thus it is possible to form toner particles having no corners.

Diameter of Toner Particles

The diameter of the toner particles of the present invention is preferably between 3.0 and 8.5 μm in terms of the number average particle diameter. When toner particles are formed employing a polymerization method, it is possible to control said particle diameter utilizing the concentration of coagulants, the added amount of organic solvents, the fusion time, or further the composition of the polymer itself.

By adjusting the number average particle diameter from 3.0 to 8.5 μm, improved is the halftone image quality as well as general image quality of fine lines, dots, and the like.

The polymerized toner, which is preferably employed in the present invention, is as follows. The diameter of toner particles is designated as D (in μm). In a number based histogram, in which natural logarithm lnD is taken as the abscissa and said abscissa is divided into a plurality of classes at an interval of 0.23, a toner is preferred, which exhibits at least 70 percent of the sum (M) of the relative frequency ($m_1$) of toner particles included in the highest frequency class, and the relative frequency ($m_2$) of toner particles included in the second highest frequency class.

By adjusting the sum (M) of the relative frequency ($m_1$) and the relative frequency ($m_2$) to at least 70 percent, the dispersion of the resultant toner particle size distribution narrows. Thus, by employing said toner in an image forming process, it is possible to securely minimize the generation of selective development.

In the present invention, the histogram, which shows said number based particle size distribution, is one in which natural logarithm lnD (wherein D represents the diameter of each toner particle) is divided into a plurality of classes at an interval of 0.23 (0 to 0.23, 0.23 to 0.46, 0.46 to 0.69, 0.69 to 0.92, 0.92 to 1.15, 1.15 to 1.38, 1.38 to 1.61, 1.61 to 1.84, 1.84 to 2.07, 2.07 to 2.30, 2.30 to 2.53, 2.53 to 2.76 . . . ). Said histogram is drawn by a particle size distribution analyzing program in a computer through transferring to said computer via the I/O unit particle diameter data of a sample which are measured employing a Coulter Multisizer under the conditions described below.

(Measurement Conditions)

(1) Aperture: 100 μm (2) Method for preparing samples: an appropriate amount of a surface active agent (a neutral detergent) is added while stirring in 50 to 100 ml of an electrolyte, Isoton R-11 (manufactured by Coulter Scientific Japan Co.) and 10 to 20 ml of a sample to be measured is added to the resultant mixture. Preparation is then carried out by dispersing the resultant mixture for one minute employing an ultrasonic homogenizer.

Preparation of Toner

The toner preferably employed in the invention is one obtained by polymerization of at least polymerizable monomer in an aqueous medium and by coagulation of at least resin particle in an aqueous medium. Examples of the method to prepare the toner will be described.

It is possible to prepare the toner of the present invention in such a manner that fine polymerized particles are produced employing a suspension polymerizing method, and emulsion polymerization of monomers in a liquid added with an emulsion of necessary additives is carried out, and thereafter, association is carried out by adding organic solvents, coagulants, and the like. Methods are listed in which during association, preparation is carried out by associating upon mixing dispersions of releasing agents, colorants, and the like which are required for constituting a toner, a method in which emulsion polymerization is carried out upon dispersing toner constituting components such as releasing agents, colorants, and the like in monomers, and the like. Association as described herein means that a plurality of resinous particles and colorant particles are fused.

An example of preparation method of the toner particles is described. Namely, added to the polymerizable monomers are colorants, and if desired, releasing agent, charge control agents, and further, various types of components such as polymerization initiators, and in addition, various components are dissolved in or dispersed into the polymerizable monomers employing a homogenizer, a sand mill, a sand grinder, an ultrasonic homogenizer, and the like. The polymerizable monomers in which various components have been dissolved or dispersed are dispersed into a water based medium to obtain oil droplets having the desired size of a toner, employing a homomixer, a homogenizer, and the like. Thereafter, the resultant dispersion is conveyed to a reaction apparatus which utilizes stirring blades described below as the stirring mechanism and undergoes polymerization reaction upon heating . . . After completing the reaction, the dispersion stabilizers are removed, filtered, washed, and subsequently dried. In this manner, the toner of the present invention is prepared.

The water based medium as described in the present invention means one in which at least 50 percent, by weight of water, is incorporated.

A method for preparing said toner may includes one in which resinous particles are associated, or fused, in a water based medium. Said method is not particularly limited but it is possible to list, for example, methods described in Japanese Patent Publication Open to Public Inspection Nos. 5-265252, 6-329947, and 9-15904. Namely, it is possible to form the toner of the present invention by employing a method in which at least two of the dispersion particles of components such as resinous particles, colorants, and the like, or fine particles, comprised of resins, colorants, and the like, are associated, specifically in such a manner that after dispersing these in water employing emulsifying agents, the resultant dispersion is salted out by adding coagulants having a concentration of at least the critical coagulating concentration, and simultaneously the formed polymer itself is heat-fused at a temperature higher than the glass transition temperature, and then while forming said fused particles, the particle diameter is allowed gradually to grow; when the particle diameter reaches the desired value, particle growth is stopped by adding a relatively large amount of water; the resultant particle surface is smoothed while being further heated and stirred, to control the shape and the resultant particles which incorporate water, is again heated and dried in a fluid state. Further, herein, organic solvents, which are infinitely soluble in water, may be simultaneously added together with said coagulants.

Those which are employed as polymerizable monomers to constitute resins include styrene and derivatives thereof such as styrene, o-methylstyrene, m-methylstyrene, p-methylstyrene, α-methylstyrene, p-chlorostyrene, 3,4-dichlorostyrene, p-phenylstyrene, p-ethylstryene, 2,4-dimethylstyrene, p-tert-butylstyrene, p-n-hexylstyrene, p-n-octylstyrene, p-n-nonylstyrene, p-n-decylstyrene, p-n-dodecylstyrene; methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethyl methacrylate, stearyl methacrylate, lauryl methacrylate, phenyl methacrylate, diethylaminoethyl methacrylate, dimethylaminoethyl methacrylate; acrylic acid esters and derivatives thereof such as methyl acrylate, ethyl acrylate, isopropyl acrylate, n-butyl acrylate, t-butylacrylate, isobutyl acrylate, n-octyl acrylate, 2-ethylhexyl acrylate, stearyl acrylate, lauryl acrylate, phenyl acrylate, and the like; olefins such as ethylene, propylene, isobutylene, and the like; halogen based vinyls such as vinyl chloride, vinylidene chloride, vinyl bromide, vinyl fluoride, vinylidene fluoride, and the like; vinyl esters such as vinyl propionate, vinyl acetate, vinyl benzoate, and the like; vinyl ethers such as vinyl methyl ether, vinyl ethyl ether, and the like; vinyl ketones such as vinyl methyl ketone, vinyl ethyl ketone, vinyl hexyl ketone, and the like; N-vinyl compounds such as N-vinylcarbazole, N-vinylindole, N-vinylpyrrolidone, and the like; vinyl compounds such as vinylnaphthalene, vinylpyridine, and the like; as well as derivatives of acrylic acid or methacrylic acid such as acrylonitrile, methacrylonitrile, acryl amide, and the like. These vinyl based monomers may be employed individually or in combinations.

Further preferably employed as polymerizable monomers, which constitute said resins, are those having an ionic dissociating group in combination, and include, for instance, those having substituents such as a carboxyl group, a sulfonic acid group, a phosphoric acid group, and the like as the constituting group of the monomers. Specifically listed are acrylic acid, methacrylic acid, maleic acid, itaconic acid, cinnamic acid, fumaric acid, maleic acid monoalkyl ester, itaconic acid monoalkyl ester, styrenesulfonic acid, allylsulfosuccinic acid, 2-acrylamido-2-methylpropanesulfonic acid, acid phosphoxyethyl methacrylate, 3-chloro-2-acid phosphoxyethyl methacrylate, 3-chlor-2-acid phosphoxypropyl methacrylate, and the like.

Further, it is possible to prepare resins having a bridge structure, employing polyfunctional vinyls such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol methacrylate, neopentyl glycol diacrylate, and the like.

It is possible to polymerize these polymerizable monomers employing radical polymerization initiators. In such a case, it is possible to employ oil-soluble polymerization initiators when a suspension polymerization method is carried out. Listed as these oil-soluble polymerization initiators may be azo based or diazo based polymerization initiators such as 2,2'-azobis-(2,4-dimethylvaleronitrile), 2,2'-azobisisobutyronitrile, 1,1'-azobiscyclohexanone-1-carbonitrile), 2,2'-azobis-4-methoxy-2,4-dimethylvaleronitrile, azobisisobutyronitrile, and the like; peroxide based polymerization initiators such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxycyclohexane)propane, tris-(t-butylperoxy) triazine, and the like; polymer initiators having a peroxide in the side chain; and the like.

Further, when such an emulsion polymerization method is employed, it is possible to use water-soluble radical polymerization initiators. Listed as such water-soluble polymerization initiators may be persulfate salts, such as potassium persulfate, ammonium persulfate, and the like, azobisaminodipropane acetate salts, azobiscyanovaleric acid and salts thereof, hydrogen peroxide, and the like.

Cited as dispersion stabilizers may be tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, alumina, and the like. Further, as dispersion stabilizers, it is possible to use polyvinyl alcohol, gelatin, methyl cellulose, sodium dodecylbenzene sulfonate, ethylene oxide addition products, and compounds which are commonly employed as surface active agents such as sodium higher alcohol sulfate.

In the present invention, preferred as excellent resins are those having a glass transition point of 20 to 90° C. as well as a softening point of 80 to 220° C. Said glass transition point is measured employing a differential thermal analysis method, while said softening point can be measured employing an elevated type flow tester. Preferred as these resins are those having a number average molecular weight (Mn) of 1,000 to 100,000, and a weight average molecular weight (Mw) of 2,000 to 1,000,000, which can be measured employing gel permeation chromatography. Further preferred as resins are those having a molecular weight distribution of Mw/Mn of 1.5 to 100, and is most preferably from 1.8 to 70.

The coagulants employed in the present invention are preferably selected from metallic salts. Listed as metallic salts, are salts of monovalent alkali metals such as, for example, sodium, potassium, lithium, etc.; salts of divalent alkali earth metals such as, for example, calcium, magnesium, etc.; salts of divalent metals such as manganese, copper, etc.; and salts of trivalent metals such as iron, aluminum, etc. Some specific examples of these salts are described below. Listed as specific examples of monovalent metal salts, are sodium chloride, potassium chloride, lithium chloride; while listed as divalent metal salts are calcium chloride, zinc chloride, copper sulfate, magnesium sulfate, manganese sulfate, etc., and listed as trivalent metal salts, are aluminum chloride, ferric chloride, etc. Any of these are suitably selected in accordance with the application.

The coagulant is preferably added not less than the critical coagulation concentration. The critical coagulation concentration is an index of the stability of dispersed materials in an aqueous dispersion, and shows the concentration at which coagulation is initiated. This critical coagulation concentration varies greatly depending on the fine polymer particles as well as dispersing agents, for example, as described in Seizo Okamura, et al, Kobunshi Kagaku (Polymer Chemistry), Vol. 17, page 601 (1960), etc., and the value can be obtained with reference to the above-mentioned publications. Further, as another method, the critical coagulation concentration may be obtained as described below. An appropriate salt is added to a particle dispersion while changing the salt concentration to measure the ζ potential of the dispersion, and in addition the critical coagulation concentration may be obtained as the salt concentration which initiates a variation in the ζ potential.

The concentration of coagulant may be not less than the critical coagulation concentration. However, the amount of the added coagulant is preferably at least 1.2 times of the critical coagulation concentration, and more preferably 1.5 times.

The solvents, which are infinitely soluble as described herein, mean those which are infinitely soluble in water, and in the present invention, such solvents are selected which do not dissolve the formed resins. Specifically, listed may be alcohols such as methanol, ethanol, propanol, isopropanol, t-butanol, methoxyethanol, butoxyethanol, and the like. Ethanol, propanol, and isopropanol are particularly preferred.

The added amount of infinitely soluble solvents is preferably between 1 and 100 percent by volume with respect to the polymer containing dispersion to which coagulants are added.

In order to make the shape of particles uniform, it is preferable that colored particles are prepared, and after filtration, the resultant slurry, containing water in an amount of 10 percent by weight with respect to said particles, is subjected to fluid drying. At that time, those having a polar group in the polymer are particularly preferable. For this reason, it is assumed that since existing water somewhat exhibits swelling effects, the uniform shape particularly tends to be made.

The toner of the present invention is comprised of at least resins and colorants. However, if desired, said toner may be comprised of releasing agents, which are fixability improving agents, charge control agents, and the like. Further, said toner may be one to which external additives, comprised of fine inorganic particles, fine organic particles, and the like, are added.

Optionally employed as colorants, which are used in the present invention, are carbon black, magnetic materials, dyes, pigments, and the like. Employed as carbon blacks are channel black, furnace black, acetylene black, thermal black, lamp black, and the like. Employed as ferromagnetic materials may be ferromagnetic metals such as iron, nickel, cobalt, and the like, alloys comprising these metals, compounds of ferromagnetic metals such as ferrite, magnetite, and the like, alloys which comprise no ferromagnetic metals but exhibit ferromagnetism upon being thermally treated such as, for example, Heusler's alloy such as manganese-copper-aluminum, manganese-copper-tin, and the like, and chromium dioxide, and the like.

Employed as dyes may be C.I. Solvent Red 1, the same 49, the same 52, the same 63, the same 111, the same 122, C.I. Solvent Yellow 19, the same 44, the same 77, the same 79, the same 81, the same 82, the same 93, the same 98, the same 103, the same 104, the same 112, the same 162, C.I. Solvent Blue 25, the same 36, the same 60, the same 70, the same 93, the same 95, and the like, and further mixtures thereof may also be employed. Employed as pigments may be C.I. Pigment Red 5, the same 48:1, the same 53:1, the same 57:1, the same 122, the same 139, the same 144, the same 149, the same 166, the same 177, the same 178, the same 222, C.I. Pigment Orange 31, the same 43, C.I. Pigment Yellow 14, the same 17, the same 93, the same 94, the same 138, C.I. Pigment Green 7, C.I. Pigment Blue 15:3, the same 60, and the like, and mixtures thereof may be employed. The number average primary particle diameter varies widely depending on their types, but is preferably between about 10 and about 200 nm.

Employed as methods for adding colorants may be those in which polymers are colored during the stage in which polymer particles prepared employing the emulsification method are coagulated by addition of coagulants, in which colored particles are prepared in such a manner that during the stage of polymerizing monomers, colorants are added and the resultant mixture undergoes polymerization, and the like. Further, when colorants are added during the polymer preparing stage, it is preferable that colorants of which surface has been subjected to treatment employing coupling agents, and the like, so that radical polymerization is not hindered.

Further, added as fixability improving agents may be low molecular weight polypropylene (having a number average molecular weight of 1,500 to 9,000), low molecular weight polyethylene, and the like.

Employed as charge control agents may also be various types of those which are known in the art and can be dispersed in water. Specifically listed are nigrosine dyes, metal salts of naphthenic acid or higher fatty acids, alkoxylated amines, quaternary ammonium salts, azo based metal complexes, salicylic acid metal salts or metal complexes thereof.

It is preferable that the number average primary particle diameter of particles of said charge control agents as well as said fixability improving agents is adjusted to about 10 to about 500 nm in the dispersed state.

The toner of the present invention exhibits more desired effects when employed after having added fine particles such as fine inorganic particles, fine organic particles, and the like, as external additives. The reason is understood as follows: since it is possible to control burying and releasing of external additives, the effects are markedly pronounced.

Preferably employed as such fine inorganic particles are inorganic oxide particles such as silica, titania, alumina, and the like. Further, these fine inorganic particles are preferably subjected to hydrophobic treatment employing silane coupling agents, titanium coupling agents, and the like. The degree of said hydrophobic treatment is not particularly limited, but said degree is preferably between 40 and 95 in terms of the methanol wettability. The methanol wettability as described herein means wettability for methanol. The methanol wettability is measured as follows. 0.2 g of fine inorganic particles to be measured is weighed and added to 50 ml of distilled water, in a beaker having an inner capacity of 200 ml. Methanol is then gradually dripped, while stirring, from a burette whose outlet is immersed in the liquid, until the entire fine inorganic particles are wetted. When the volume of methanol, which is necessary for completely wetting said fine inorganic particles, is represented by "a" ml, the degree of hydrophobicity is calculated based on the formula described below:

$$\text{Degree of hydrophobicity}=[a/(a+50)]\times 100$$

The added amount of said external additives is generally between 0.1 and 5.0 percent by weight with respect to the toner, and is preferably between 0.5 and 4.0 percent. Further, external additives may be employed in combinations of various types.

In toners prepared employing a suspension polymerization method in such a manner that toner components such as colorants, and the like, are dispersed into, or dissolved in, so-called polymerizable monomers, the resultant mixture is suspended into a water based medium; and when the resultant suspension undergoes polymerization, it is possible to control the shape of toner particles by controlling the flow of said medium in the reaction vessel. Namely, when toner particles, which have a shape coefficient of at least 1.2, are formed at a higher ratio, employed as the flow of the medium in the reaction vessel, is a turbulent flow. Subsequently, oil droplets in the water based medium in a suspension state gradually undergo polymerization. When the polymerized oil droplets become soft particles, the coagulation of particles is promoted through collision and particles having an undefined shape are obtained. On the other hand, when toner particles, which have a shape coefficient of not more than 1.2, are formed, employed as the flow of the medium in the reaction vessel is a laminar flow. Spherical particles are obtained by minimizing collisions among said particles. By employing said methods, it is possible to control the distribution of shaped toner particles within the range of the present invention. Reaction apparatuses, which are preferably employed in the present invention, will now be described.

A reaction apparatus which can be preferably used in a suspension polymerization method will be explained by using the drawings.

Figure 7:
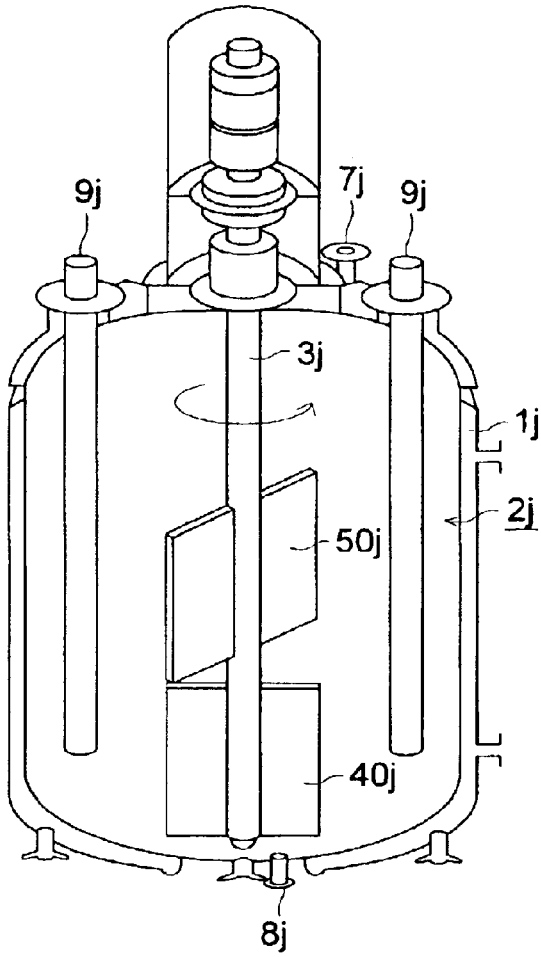
Figure 8:
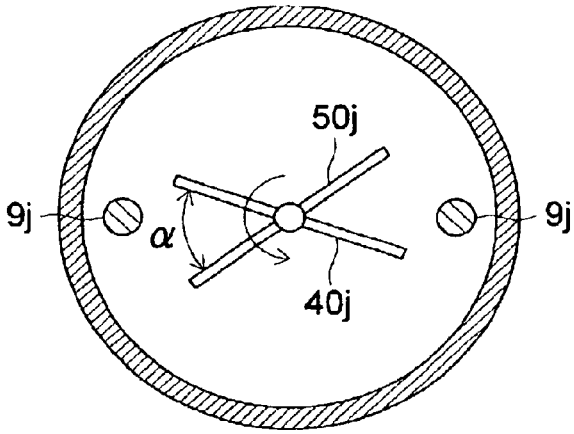

FIG. 7 and FIG. 8 are a perspective view and a cross-sectional view respectively both showing an example of such a reaction apparatus. In the reaction apparatus shown in FIG. 7 and FIG. 8, a rotary shaft 3*j* is mounted vertically at the central part of a vertical cylindrical stirring tank 2*j* with a jacket 1*j* for heat exchange mounted on the outer circumference portion of the stirring tank, and a stirring plane 40*j* mounted to the rotary shaft 3*j* close to the bottom surface of the stirring tank 2 and a stirring plane 50*j* mounted to the shaft at an upper position of this stirring plane 40*j* are provided. The upper stirring plane 50*j* is arranged in such a way as to make a crossing angle α preceding in the rotating direction with the stirring plane positioned at the lower stage. In the case where a toner of this invention is produced, it is desirable to make the crossing angle α smaller than 90°. Although there is no lower limitation for this crossing angle α, it is desirable that it is not smaller than about 5°, and more desirably, it should be not smaller than 10°. In addition, in the case where stirring planes having a three-stage structure are provided, it is desirable that the crossing angle between any stirring plane and its neighboring stirring plane is smaller than 90°.

By making the structure like this, the following process is presumed. That is, the medium is stirred by the stirring plane 50*j* arranged at the upper stage first, which forms a downward flow. Subsequently, by the stirring plane 40*j* arranged at the lower stage, the flow having been formed by the upper-stage stirring plane 50*j* is accelerated further downward, while another flow is separately formed by the upper-stage stirring plane 50*j* itself, the flow as a whole is accelerated and proceeds. It is presumed that, as the result of this, because a flow region having a large shearing force formed as a turbulent flow is formed, the shape of the toner particles to be obtained can be controlled.

Besides, in FIG. 7 and FIG. 8, the arrow marks show the direction of rotation, and 7*j* denotes an upper inlet for introducing material, 8*j* denotes a lower inlet for introducing material, 9*j* denotes a turbulent flow forming member for making stirring effective.

In the above, as regards the shape of the stirring planes, there is no particular limitation; quadrangular-shaped plate, one having a notch at a part of the plane, one having one or more through holes, so called slits, at the central part of each half plane, etc. can be used. Concrete examples of these are noted in FIG. 9(*a*) to FIG. 9(*d*). The stirring plane 5*a* shown in FIG. 9(*a*) is one having no through hole portion, the stirring plane 5*b* shown in FIG. 9(*b*) is one having a large through hole portion 6*b* at the center of each half plane, the stirring plane 5*c* shown in FIG. 9(*c*) is one having a through hole portion composed of two slits which are laterally long in each half plane, and the stirring plane 5*d* shown in FIG. 9(*d*) is one having a through hole portion composed of two slits which are vertically long in each half plane. Further, in the case where stirring planes having a three-stage structure are provided, the through hole portion formed in the upper-stage stirring plane and the through hole portion formed in the lower-stage stirring plane may have different shapes respectively or may have the same shape.

In addition, as regards the clearance between the upper-stage stirring plane and the lower-stage stirring plane, there is no particular limitation, but it is desirable at least a clearance is provided between the upper and lower stirring planes. The reason for this is not certain, but it can be considered that the efficiency of stirring is improved because a flow of the medium is formed through the clearance. In addition, it is desirable that the clearance has a width of 0.5 to 50% to the height of the liquid surface in a still-standing state, and more desirably it should have a width of 1 to 30% to that height.

Further, as regards the size of the stirring planes, there is no particular limitation, but it is desirable that the total sum of the height of all the stirring planes is 50% to 100% to the height of the liquid surface in a still-standing state, and more desirably, it should be 60 to 95% to that height.

On the other hand, as regards a toner produced by a polymerization method in which resin particles are associated or fusion-bonded to one another in an aqueous medium, by controlling the flow and temperature distribution of the medium in the reaction vessel at the stage of fusion-bonding, further by controlling the heating temperature, the number of revolutions of stirring, and the time in the shape controlling process after fusion-bonding, the shape distribution and the shape of toner particles as a whole can be arbitrarily changed.

That is, as regards a toner produced by a polymerization method in which resin particles are associated or fusion-bonded to one another in an aqueous medium, by using stirring planes and a stirring tank capable of making the flow in the reaction apparatus laminar and the temperature distribution of the inside uniform, and controlling the temperature, the number of revolutions, and the time in the fusion-bonding process and the shape controlling process, a toner having a uniform shape distribution can be formed. The reason of this is presumed in the following way. If fusion-bonding is made in a field where a laminar flow is formed, a strong stress does not act on the particles being subjected to proceeding flocculation and fusion-bonding (particles in process of association or flocculation), and in the laminar flow with its flow speed accelerated, the temperature distribution in the stirring tank is uniform. As the result of this, the shape distribution of the fusion-bonded particles becomes uniform. Further, by the heating and stirring in the shape controlling process after that, the fusion-bonded particles are gradually made spherical, and the shape of the toner particles can be arbitrarily controlled.

For the stirring planes and the stirring tank to be used in producing a toner by a polymerization method in which resin particles are associated or fusion-bonded to one another, those can be used which are the same as ones used in the case where a laminar flow is formed in the above-mentioned suspension polymerization method. The feature is that there is not provided an obstructing member such as a hindering plate which causes a turbulent flow to be formed.

As regards also the shape of these stirring planes, it can be employed the same one as that employed in the case where a laminar flow is formed in the above-mentioned suspension polymerization method, and there is no particular limitation so long as it does not cause a turbulent flow to be formed. A stirring plane having a shape formed by a continuous surface such as a quadrangular-shaped plate as shown by FIG. 9(C) or a curved surface may be employed.

As regards a toner to be used in this invention, for example, a case where it is used as a magnetic toner for a single component developer with the particles made to contain a magnetic substance, a case where it is used as a toner in a two-component developer by being mixed with what is called a carrier, a case where it is used singly as a non-magnetic toner, etc. can be considered; in any case, it can be appropriately used.

EXAMPLES

The invention will be detailed according to examples. Herein, "parts" in the following explanation represents weight parts.

Example 1

Preparation of a Photoreceptor

Preparation of Photoreceptor 1

The following dispersion was prepared and coated on a cylindrical aluminum base element being manufactured by drawing, of which surface having been adjusted through a cutting process to have a ten-point surface roughness of 1.5 μm, to form a electric conductive layer having a dry layer thickness of 15 μm.

| Photoconductive layer (PCL) composition solution: | |
|---|---|
| Phenol resin | 160 parts |
| Photoconductive titanium oxide pigment | 200 parts |
| Methyl cellosolve | 100 parts |

The following under-coating layer composition solution was prepared. This coating composition was coated on the above-described photoconductive layer by means of an immersion coating method to form an under coating layer having a layer thickness of 1.0 μm.

| Under coating layer (UCL) composition solution: | |
|---|---|
| Polyamide resin (Amilan ® CM-8000: manufactured by Toray Corp.) | 60 parts |
| Methanol | 1600 parts |
| 1-butanol | 400 parts |

The following coating composition solution was mixed, and dispersed by use of a sand mill for 10 hours to prepare a charge generating layer coating composition. The coating composition is coated by means of an immersion coating method on the above-described under coating layer to form a charge generating layer having a dry layer thickness of 0.2 μm.

| Charge generating layer (CGL) composition solution: | |
|---|---|
| Oxytitanyl phthalocyanine pigment (a maximum peak degree of 27.3 based on 2θ, by Cu-Kα characteristic X-ray) | 60 parts |
| Silicone resin solution (KR 5240, 15% xylene butanol solution: manufactured by Shin-Etsu Chemical Co., Ltd.) | 700 parts |
| 2-butanone | 2000 parts |

The following coating composition solution was mixed and dissolved to prepare a charge transport layer coating composition. The coating composition is coated on the above-described charge generating layer by means of a immersion coating method to form a charge transport layer having a dry layer thickness of 20 μm, and to prepare photoreceptor 1. Photoreceptor 1 had a average surface roughness (Ra) of 2.15 nm and a ten-point average surface roughness (Rz) of 0.07 μm.

| Charge transport layer (CTL) composition solution: | |
|---|---|
| Charge transport substance (N-(4-methylphenyl)-N-{4-(β-phenylstyryl)phenyl}-p-toluidine) | 200 parts |
| Bisphenol Z type polycarbonate (a one-time methanol purified product of Iupilon Z300: manufactured by Mitsubishi Plastic-Engineering Corporation) | 300 parts |
| Hydrophobic silica (number average particle diameter: 7 nm) | 30 parts |
| 1,2-dichloroethane | 2000 parts |

Preparation of Photoreceptor 2

Photoreceptor 2 was prepared in a similar manner to the preparation of photoreceptor 1, except that a charge transport layer (CTL) composition solution was changed to the following composition solution. The photoreceptor 2 had Ra of 35.6 nm and Rz of 3.0 μm.

| Charge transport layer composition solution: | |
|---|---|
| Charge transport substance (N-(4-methylphenyl)-N-{4-(β-phenylstyryl)phenyl}-p-toluidine) | 200 parts |
| Bisphenol Z-type polycarbonate (Iupilon Z300: manufactured by Mitsubishi Engineering-Plastics Corporation) | 300 parts |
| 1,2-dichloroethane | 2000 parts |
| Hydrophobic silica (number average particle diameter: 45 nm) | 30 parts |
| Teflon (R) fine particles (a thermally treated product having a mean particle diameter of 5 μm) | 100 parts |

Preparation of Photoreceptor 3:

The following composition solution was mixed and dissolved to prepare an over-coating layer composition solution, which was coated on a CTL of photoreceptor 2.

Over-Coating Layer (OCL) Composition Solution:

Polysiloxane resin of 10 parts comprised of 80 mole % of a methylsiloxane unit and 20 mole % of a methylphenylsiloxane unit was added with molecular sieve 4A, and the system was kept standing for 24 hours to be dehydrated. The resin was dissolved in 10 weight parts of toluene, and 5 weight parts of methyltrimethoxy silane and 0.2 weight parts of dibutyl tin acetate were added thereto to make a homogeneous solution. Further, 6 weight parts of dihydroxymethyltriphenylamine (the compound described below) and 7 weight parts of hydrophobic silica (mean particle diameter: 130 nm) were added thereto, and the solution was coated as an over-coating layer having a dry layer thickness of 2 μm, followed by thermal curing at 130° C. for 1 hour to prepare photoreceptor 3. The photoreceptor 3 had Ra of 96.6 nm and Rz of 1.3 μm.

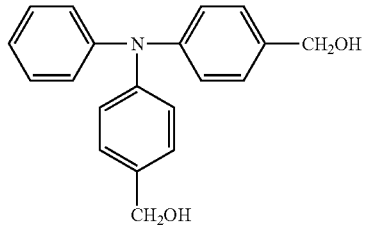

Preparation of Photoreceptor 4

Photoreceptor 4 was prepared in a similar manner to the preparation of photoreceptor 1, except that a charge transport layer (CTL) composition solution was changed to the following composition solution. The photoreceptor 4 had Ra of 24.2 nm and Rz of 0.2 μm.

| Charge transport layer composition: | |
|---|---|
| Charge transport substance (N-(4-methylphenyl)-N-{4-(β-phenylstyryl)phenyl}-p-toluidine) | 75 parts |
| Polycarbonate resin (Iupilon Z300: manufactured by Mitsubishi Plastic-Engineering Corporation.) | 10 parts |
| Methylene chloride | 75 parts |
| Hydrophobic silica (number average particle diameter: 0.5 μm, silicone oil treated) | 20 parts |

Preparation of Surface Energy-lowering Agents A to F

Sodium stearate was dissolved in water to prepare a 15 weight % solution. Further, zinc sulfate was dissolved in water to prepare a 25 weight % solution. A 2-liter receiving vessel equipped with a stirring device having a turbine fun of 6 cm diameter is prepared and the turbine fun was rotated at 350 rpm. Sodium stearate solution was charged in the receiving vessel and the solution temperature was adjusted to 80° C. Next, zinc sulfate solution kept at 80° C. was added drop-wise in 30 minutes to the receiving vessel. The equivalent ratio of sodium stearate to zinc sulfate was 0.98 and they were mixed so as to make up metal soap slurry to 500 g. After finishing the total addition, the system was ripened for 10 minutes in a state of a reaction process temperature to complete the reaction. Next, the metal soap slurry thus obtained was washed twice with water, followed by washing by use of water. The metal soap cake obtained was dried at a drying temperature of 110° C. and solidified by a pressure of 150 kg/cm$^2$. Thereafter, it was kept under an environmental condition of 30° C. and 80% RH for 24 hours to prepare solid materials of zinc stearate (surface energy-lowering agents A to F) having varied water contents as shown in Table 1. The water contents of A to F were adjusted by changing a drying time at 110° C.

TABLE 1

| Kind of Surface energy-lowering agent | Material (Water content: weight %) |
|---|---|
| A | Zinc stearate (0.05) |
| B | Zinc stearate (0.1) |
| C | Zinc stearate (1.0) |
| D | Zinc stearate (2.5) |
| E | Zinc stearate (4.5) |
| F | Zinc stearate (5.5) |

Preparation of Toner and Developer

Toner Manufacturing Example 1: an Example of Emulsion Polymerizing Association Method Sodium n-dodecyl sulfate of 0.90 kg and 10.0 liters of pure water were charged, stirred and dissolved. Regal 330R (carbon black manufactured by Cabot Co.) of 1.20 kg was added gradually to the solution, and after sufficient stirring for 1 hour the system was dispersed continuously for 20 hours by use of a sand grinder (a media type dispersing apparatus). The resulting product was "colorant dispersion solution 1".

Further, a solution comprised of 0.055 kg of sodium dodecylbenzene sulfonate and 4.0 liters of ion-exchanged was "anion surfactant solution A".

A solution comprised of 0.014 kg of nonylphenol polyethleneoxide 10-mole adduct and 4.0 liters of ion-exchanged was "nonion surfactant solution B".

A solution in which 223.8 g of potassium persulfate were dissolved in 12.0 liters of ion-exchanged water was "initiator solution C".

Into a GL (glass lining treated) reaction vessel having a volume of 100 liters and equipped with a temperature sensor, a cooling tube and a nitrogen introducing device, added were 3.41 kg of WAX emulsion (polypropylene emulsion having a number average molecular weight of 3000: number average primary particle diameter=120 nm/solid concentration=29.9%) and the total amount of "anion surfactant solution A" and the total amount of "nonion surfactant solution B", and stirring was started. Next, 44.0 liters of ion-exchanged water were added.

Heating was started and the total amount of "initiator solution C" was added drop-wise when the temperature reached 75° C. Thereafter, 12.1 kg of styrene, 2.88 kg of n-butyl acrylate, 1.04 kg of methacrylic acid and 548 g of t-dodecyl mercaptan were added drop-wise while controlling the temperature at 75° C.±1° C. After finishing the drop-wise addition the solution temperature was raised to 80° C.±1° C. and the system was stirred for 6 hours while being heated. Thereafter, the solution temperature was cooled down to not higher than 40° C. to stop stirring, and was filtered through a pole filter to obtain latex. This was "latex-A".

Herein, the resin particles in latex-A had a glass transition temperature of 57° C., a softening point of 121° C., a molecular weight distribution of 12,700 based on a weight average molecular weight, and a weight average particle diameter of 120 nm.

A solution in which 0.055 kg of sodium dodecylbenzene sulfonate was dissolved in 4.0 liters of ion-exchanged was "anion surfactant solution D".

Further, a solution in which 0.014 kg of nonylphenol polyethyleneoxide 10-mole adduct were dissolved in 4.0 liters of ion-exchanged was "nonion surfactant solution E".

A solution in which 200.7 g of potassium persulfate were dissolved in 12.0 liters of ion-exchanged water was "initiator solution F".

Into a GL reaction vessel having a volume of 100 liters and equipped with a temperature sensor, a cooling tube, a nitrogen introducing device and a comb-shaped baffle, added were 3.41 kg of WAX emulsion (polypropylene emulsion having a number average molecular weight of 3000: number average primary particle diameter=120 nm/solid concentration=29.9%) and the total amount of "anion surfactant solution D" and the total amount of "nonion surfactant solution E", and stirring was started.

Next, 44.0 liters of ion-exchanged water were added. Heating was started and the total amount of "initiator solution F" was added drop-wise when the temperature reached 70° C. Thereafter, a solution, in which 11.0 kg of styrene, 4.00 kg of n-butyl acrylate, 1.04 kg of methacrylic acid and 9.02 g of t-dodecyl mercaptan had been mixed in advance, was added drop-wise. After finishing the drop-wise addition the solution temperature was controlled at 72° C.±2° C. and the system was stirred for 6 hours while being heated. Further, the solution temperature was raised up to 80° C.±2° C. and the system was stirred for 12 hours while being heated. The solution temperature was cooled down to not higher than 40° C. to stop stirring. The resulting solution was filtered through a pole filter to obtain a filtrate as "latex-B".

Herein the resin particles in latex-B had a glass transition temperature of 58° C., a softening point of 132° C., a molecular weight distribution of 245,000 based on a weight average molecular weight and a weight average particle diameter of 110 nm.

A solution, in which 5.36 kg of sodium chloride as a salting out agent were dissolved in 20.0 liters of ion-exchanged water, was "sodium chloride solution G".

A solution, in which 1.00 g of fluorine-contained nonion surfactant was dissolved in 1.00 liter of ion-exchanged water, was "nonion surfactant solution H".

Latex-A of 20.0 kg, 5.2 kg of latex-B and 0.4 kg of colorant dispersion solution, which were prepared above, and 20.0 kg of ion-exchanged water were charged in a 100-liter SUS reaction vessel equipped with a temperature sensor, a cooling tube, a nitrogen introducing device and a device to monitor a particle size and shape (a reaction apparatus of which construction is illustrated in FIG. 7, a cross degree $\alpha$ is 25°) and the system was stirred. Next, the system was heated at 40° C., and sodium chloride solution G, 6.00 kg of isopropanol (manufactured by Kanto Kagaku Co.) and nonion surfactant solution H were added in this order. Thereafter, after the system was kept standing for 10 minutes heating was started, the solution temperature was raised up to 85° C. in 60 minutes, and particle diameter was grown up while being salted out/fused by being heated and stirred at 85° C.±2° C. for from 0.5 to 3 hours. Next, particle diameter growth was stopped by addition of 2.1 liters of pure water to prepare a fused particle dispersion solution.

The fused particle dispersion prepared above of 5.0 kg was charged in a 5-liter reaction vessel equipped with a temperature sensor, a cooling tube, and a device to monitor a particle size and shape (a reaction apparatus of which construction is illustrated in FIG. 7, a cross degree $\alpha$ is 20°) and stirred while being heated at a solution temperature of 85°C.±2° C. for from 0.5 to 15 hours to control the particle shape. Thereafter, the system was cooled down to not higher than 40° C., and stirring was ceased. Next, classification in a solution by a centrifugal sedimentation method was performed by use of a centrifuge and filtration through a sieve of 45 μm mesh was performed to obtain a filtrate, which was an associated liquid. Then, non-spherical particles of a wet cake state were filtered off from the associated liquid by use of a Buchner funnel. Thereafter, the particles obtained were washed by ion-exchanged water. The non-spherical particles were dried by use of a flash jet drier at a suction air temperature of 60° C., followed by being dried at a temperature of 60° C. by use of a fluid bed drier. Silica fine particles of 1 weight part was added and mixed by use of a Henschel mixer to 100 weight parts of colorant particles obtained above to prepare a toner by means of an emulsion polymerizing association method.

In the monitoring of a salting out/fusing step and of a shape controlling process, a shape and a variation coefficient of a shape coefficient were controlled by controlling a stirring revolution and heating time, and further a particle size and a variation coefficient of a particle size distribution were adjusted arbitrary by classification in a solution to obtain toners 1 Bk to 17 Bk having the shape characteristics and the particle size distribution characteristics shown in Table 2.

TABLE 2

| Toner No. | Ratio of toner particles having a shape factor of from 1.2 to 1.6 (%) | A variation coefficient of a shape factor of toner particles (%) | Ratio of toner particles without corners (%) | Number average particle diameter of toner particles (μm) | Number variation coefficient of toner particles | $M(m_1 + m_2)$ (%) |
|---|---|---|---|---|---|---|
| 1Bk | 68.3 | 15.2 | 88 | 5.6 | 25.9 | 80.7 |
| 2Bk | 73.2 | 12.2 | 94 | 5.7 | 20.7 | 82.3 |
| 3Bk | 65.1 | 14.8 | 52 | 5.4 | 26.6 | 71.4 |
| 4BK | 63.4 | 15.7 | 51 | 5.3 | 26.1 | 70.5 |
| 5Bk | 67.7 | 16.8 | 53 | 5.6 | 26.5 | 72.4 |
| 6Bk | 68.2 | 16.9 | 88 | 5.7 | 22.0 | 79.8 |
| 7Bk | 67.7 | 15.2 | 46 | 5.6 | 25.9 | 80.7 |
| 8Bk | 74.1 | 12.4 | 89 | 5.7 | 27.8 | 71.6 |
| 9Bk | 65.1 | 15.0 | 51 | 5.6 | 25.6 | 67.4 |
| 10Bk | 60.2 | 17.2 | 53 | 5.7 | 25.8 | 70.5 |
| 11Bk | 66.1 | 16.9 | 42 | 5.7 | 22.0 | 79.8 |
| 12Bk | 65.1 | 17.7 | 55 | 5.5 | 26.7 | 71.0 |
| 13Bk | 67.7 | 16.8 | 53 | 5.6 | 26.2 | 68.2 |
| 14Bk | 62.1 | 15.1 | 40 | 7.7 | 26.0 | 68.2 |
| 15Bk | 62.5 | 17.2 | 53 | 8.2 | 25.8 | 67.8 |
| 16Bk | 60.5 | 17.8 | 42 | 5.7 | 26.2 | 68.3 |
| 17Bk | 61.5 | 18.0 | 44 | 5.7 | 28.4 | 65.3 |

Manufacturing of a Developer

Each 10 weight parts of toners 1 Bk to 17 Bk of and 100 weight parts of a 45 μm ferrite carrier covered with a styrene-methacrylate copolymer were mixed to manufacture developers 1 BK to 17 Bk for evaluation.

Evaluation

A cleaning means shown in FIG. 5 was mounted as a cleaning means for a photoreceptor of a digital color printer, shown in FIG. 1, being provided with an intermediate transfer element, photoreceptor, surface energy-lowering agents and toners, in addition to Rz of an intermediate transfer element and an intrusion amount of cleaning brush were combined with the digital color printer as shown in Table 3, followed by printing continuously 100,000 sheets of a A4 monochromatic image having a picture element ratio of 8% under a condition of high temperature and high humidity (30° C., 80% RH), and the results were evaluated. Evaluation items and evaluation criteria are shown below.

TABLE 3

| Combination No. | Surface energy lowering agent (water content: weight %) | Toner No. | Photoreceptor No. (Rz: μm) | Rz of intermediate transfer element: μm | Intrusion amount of cleaning brush (mm) |
|---|---|---|---|---|---|
| 1 | C (1.0) | 1Bk | 1 (0.07) | 0.9 | 0.6 |
| 2 | C (1.0) | 2Bk | 4 (0.2) | 0.9 | 1.3 |
| 3 | C (1.0) | 3Bk | 3 (1.3) | 1.5 | 1.0 |
| 4 | C (1.0) | 4Bk | 3 (1.3) | 1.5 | 1.0 |
| 5 | C (1.0) | 5Bk | 3 (1.3) | 1.5 | 1.0 |
| 6 | C (1.0) | 6Bk | 3 (1.3) | 1.5 | 1.0 |
| 7 | C (1.0) | 7Bk | 3 (1.3) | 1.5 | 1.0 |
| 8 | C (1.0) | 8Bk | 3 (1.3) | 1.5 | 1.0 |
| 9 | C (1.0) | 9Bk | 3 (1.3) | 1.5 | 1.0 |
| 10 | C (1.0) | 10Bk | 3 (1.3) | 1.5 | 1.0 |
| 11 | C (1.0) | 11Bk | 3 (1.3) | 1.5 | 1.0 |
| 12 | C (1.0) | 12Bk | 3 (1.3) | 1.5 | 1.0 |
| 13 | C (1.0) | 13Bk | 3 (1.3) | 1.5 | 1.0 |
| 14 | C (1.0) | 14Bk | 3 (1.3) | 1.5 | 1.0 |
| 15 | C (1.0) | 15Bk | 3 (1.3) | 1.5 | 1.0 |
| 16 | C (1.0) | 16Bk | 3 (1.3) | 1.5 | 1.0 |
| 17 | C (1.0) | 17Bk | 3 (1.3) | 1.5 | 1.0 |
| 18 | A (0.05) | 2Bk | 3 (1.3) | 1.5 | 1.0 |
| 19 | B (0.1) | 2Bk | 2 (3.0) | 1.5 | 0.6 |
| 20 | D (2.5) | 2Bk | 3 (1.3) | 1.5 | 1.3 |
| 21 | E (4.5) | 2Bk | 3 (1.3) | 1.5 | 1.0 |
| 22 | F (5.5) | 2Bk | 3 (1.3) | 1.5 | 1.0 |
| 23 | Non | 2Bk | 3 (1.3) | 1.5 | 1.0 |

Evaluation Items and Evaluation Criteria

Measurement of a Contact Angle of a Photoreceptor

After the evaluation of 100,000 sheets of print described above, a contact angle of the surface of a photoreceptor against pure water was measured by use of a contact angle meter (CA-DT-A•type: produced by Kyowa Interface Science Co., Ltd.) under an environment of 30° C. and 80% RH.

Generation of Hollow Characters

Characters were observed under magnification and existence of hollow character generation was observed visually.

Evaluation Criteria are as Follows:

A: no significant hollow characters are generated until the finish of 100,000 sheets print, B: no significant hollow characters are generated until the finish of 50,000 sheets print, C: Significant hollow characters are generated in a print of less than 50,000 sheets Evaluation of Scattered Characters A 10% screen image was formed in a whole image area in stead of a dot image constituting a character, and toner scatter around a dot was observed through a loupe.

A: minimal toner scatter is observed until the finish of 100,000 sheets print,

B: minimal toner scatter is observed until the finish of 50,000 sheets print,

C: increased toner scatter is observed in a print of less than 50,000 sheets (being problematic in practical use).

Evaluation of Cleaning Property

Appearance of toner escape due to friction between a photoreceptor and a cleaning blade, and generation of blade twist (a turning over phenomenon of a blade) were evaluated.

A: no toner escape and blade twist are observed until the finish of 100,000 sheets print, B: no toner escape and blade twist are observed until the finish of 50,000 sheets print, C: toner escape or blade twist is observed at a print of less than 50,000 sheets.

Evaluation of Image Quality

Whether each color density is sufficient or not, and sharpness of an image (whether an image is sharp or granular) were mainly evaluated.

Image density (It was measured by use of RD-918 produced by Macbeth Co., based on a relative reflective density setting a reflective density of paper to "0".)

A: the maximum density is not less than 1.2,

B: the maximum density is not less than 0.8 and less than 1.2,

C: the maximum density is less than 0.8.

Sharpness of Image

Reproducibility of fine lines and image sharpness were evaluated according to fill-in of characters, by forming an image under an environment of high temperature and ordinary humidity (a temperature of 33° C. and a relative humidity of 50%). Evaluation was performed according to the following criteria, by forming an image of 3-point and 5-point characters.

A: both 3-point and 5-point characters are clear and easily readable,

B: a part of 3-point characters is not readable, but 5-point characters are clear and easily readable, C: 3-point characters are hardly readable, and a part of or all of 5-point characters are unreadable.

Other Evaluation Conditions

Line velocity of image formation L/S: 180 mm/s

Charging conditions of a photoreceptor (60 mm ϕ): An electric potential of a non-image portion was detected by a potential sensor and controlled by means of feed-back, a controllable range thereof being from −500 V to −900 V, and the surface voltage of a photoreceptor when being flush exposed was in a range of from −50 V to 0 V.

Light source for image exposure: Semiconductor laser (wavelength: 780 nm)

Intermediate transfer element: Seamless and endless belt-form intermediate transfer element 70 was utilized, which was made of a semi-conductive resin having a volume specific resistance of $1\times10^8$ Ω·cm. Two kinds of Rz, of 0.9 μm and of 1.5 μm, were used.

Primary Transfer Conditions

Primary transfer roller (5Y, 5M, 5C and 5K (each has 6.05 mm ϕ) of FIG. 1): a constitution in which elastic rubber is attached on a core metal: a surface specific resistance of $1\times10^6$ Ω, being applied with a transfer potential Secondary Transfer Conditions Utilizing endless belt-form intermediate transfer element 70 as an intermediate transfer element, back-up roller 74 and secondary transfer roller 5A were arranged so as to sandwich the element, a resistance of a back-up roller being $1\times10^6$ Ω, a resistance of a secondary transfer roller as a secondary transfer means being $1\times10^6$ Ω and being controlled to have a constant electric current (approximately 80 μA).

Fixing was performed by means of a thermal fixing method utilizing a fixing roller provided with a heater being arranged inside thereof.

Distance Y on an intermediate transfer element from the first contact point of an intermediate transfer element with a photoreceptor to the first contact point with the next color photoreceptor was set to 95 mm.

A surrounding length (circumferential length) of driving roller 71, guide rollers 72, 73 and back-up roller 74 was set to 31.67 mm (=95 mm/3), and a surrounding length of tension roller 76 was set to 23.7 mm (=95 mm/4).

Further a surrounding length of a primary transfer roller was set to 19 mm (=95 mm/5).

Conditions for Cleaning of a Photoreceptor

Cleaning blade: an urethane rubber blade was in pressing contacted with a photoreceptor by a counter method with respect to a rotation direction of a photoreceptor.

Cleaning brush: made of an electric conductive acrylic resin, a brush hair density of $3\times10^3/cm^2$: three kinds having intrusion amounts of 0.6, 1.0 and 1.3 mm were utilized.

Secondary transfer roller (5A of FIG. 1): a constitution in which elastic rubber was attached on a core metal; transfer voltage was applied Condition for cleaning of an intermediate transfer roller Cleaning blade: an urethane rubber blade was in pressing contacted with an intermediate transfer element by a counter method with respect to a progressive direction of an intermediate transfer element.

The results are shown in Table 4.

TABLE 4

| Combination No. | Contact angle of photoreceptor | Hollow characters | Scattered characters | Cleaning property | Image density | Sharpness | Remarks |
|---|---|---|---|---|---|---|---|
| 1 | 108° | A | A | A | A | A | Inv. |
| 2 | 108° | A | A | A | A | B | Inv. |

TABLE 4-continued

| Combination No. | Contact angle of photoreceptor | Hollow characters | Scattered characters | Cleaning property | Image density | Sharpness | Remarks |
|---|---|---|---|---|---|---|---|
| 3 | 106° | A | A | A | A | A | Inv. |
| 4 | 104° | A | A | B | A | B | Inv. |
| 5 | 104° | A | A | B | A | B | Inv. |
| 6 | 104° | A | A | B | A | B | Inv. |
| 7 | 104° | A | A | B | A | B | Inv. |
| 8 | 104° | A | B | B | B | B | Inv. |
| 9 | 104° | A | B | B | B | B | Inv. |
| 10 | 102° | B | A | B | B | B | Inv. |
| 11 | 102° | B | B | B | B | B | Inv. |
| 12 | 102° | B | A | B | B | B | Inv. |
| 13 | 102° | B | A | B | B | B | Inv. |
| 14 | 102° | B | B | B | B | B | Inv. |
| 15 | 101° | B | B | B | B | B | Inv. |
| 16 | 101° | B | B | B | B | B | Inv. |
| 17 | 100° | C | C | C | B | C | Comp. |
| 18 | 110° | A | A | A | A | A | Inv. |
| 19 | 110° | A | A | A | A | B | Inv. |
| 20 | 100° | A | A | A | A | A | Inv. |
| 21 | 96° | B | B | B | B | B | Inv. |
| 22 | 87° | C | C | C | B | C | Comp. |
| 23 | 82° | C | C | C | C | C | Comp. |

Inv.: The invention
Comp.: Comparative Sample

It is clear from Table 4 that combinations 1 to 16 and 18 to 21 in which a water content of a surface energy-lowering agent being applied on the surface of a photoreceptor is not more than 4.5 weight % and a toner of the invention was utilized, compared to, combination 22 in which a surface energy-lowering agent out of the invention having a water content of 5.5 weight % was supplied, combination 17 in which a toner other than the invention is utilized and combination 23 in which both a water content and a toner are out of the invention, have been improved in all the evaluation items including hollow characters and scattered characters. Particularly, combinations 1 to 3 and 18 to 20, in which a surface energy-lowering agent having a water content of not more than 2.5 weight % and toners 1Bk, 2Bk and 3Bk satisfying the all items of shape characteristics and particle size distribution characteristics are combined, shows excellent evaluation results.

Example 2

Toners of 6 kinds 1Y, 1M, 1C, 17Y, 17M and 17C shown in Table 5 having a similar shape coefficient to toner 1Bk and toner 17 Bk were prepared in a similar manner to the preparation of a toner used in Example 1, except that C.I. Pigment yellow 185 (Y toner), C.I. Pigment red 122 (M toner) and C. I. Pigment blue 15:3 (C toner) were utilized instead of Regal 330R (carbon black manufactured by Cabot Co.) in a colorant dispersion solution.

TABLE 5

| Toner No. | Ratio of toner particles having a shape factor of from 1.2 to 1.6 (%) | A variation coefficient of a shape factor of toner particles (%) | Ratio of toner particles without corners (%) | Number average particle diameter of toner particles (μm) | Number variation coefficient of toner particles | $M(m_1 + m_2)$ (%) |
|---|---|---|---|---|---|---|
| 1Y | 68.1 | 14.8 | 86 | 5.6 | 25.5 | 81.5 |
| 2M | 68.2 | 14.5 | 88 | 5.6 | 24.8 | 80.5 |
| 3C | 67.8 | 14.9 | 87 | 5.6 | 24.5 | 82.0 |
| 17Y | 62.1 | 18.1 | 43 | 5.7 | 28.2 | 65.6 |
| 17M | 62.3 | 18.3 | 45 | 5.7 | 28.3 | 65.4 |
| 17C | 62.2 | 18.2 | 44 | 5.7 | 28.6 | 65.3 |

Production of Developer

Each 10 weight parts of 1Y, 1M, 1C, 17Y, 17M and 17C and 100 weight parts of a 45 μm ferrite carrier coated with a styrene-methacrylate copolymer were mixed to produce developers 1Y, 1M, 1C, 17Y, 17M and 17C for evaluation.

Image evaluation similar to Example 1 was performed using developer 1 group comprising developers 1Bk, 1Y, 1M and 1C, and developer 17 group comprising 17Bk, 17Y, 17M and 17C. Herein, 10,000 sheets of a color image by an intermediate transfer method were printed, by standardizing a surface energy-lowering agent as C, a photoreceptor as 3, Rz of an intermediate transfer element as 1.5, an intrusion amount of cleaning as 1.0 mm, and setting other conditions to the same as those in Example 1. As a result, with respect to color images utilizing developer 1 group, no generation of image defects of hollow characters and scattered characters were exhibited to achieve images having excellent sharpness, whereas, with respect to color images utilizing developer 17 group hollow characters became significant at around over 1000 sheets copy and generation of scattered characters increased at around over 3000 sheets copy resulting in progressive deterioration of image sharpness being exhibited.

An image forming method of the invention is generally applicable to an electro-photographic equipment such as an electrophotographic copier, a laser printer, a LED printer and a liquid crystal shutter type printer, and is further widely applicable to also equipment of such as display, recording, short-run printing, plate making and facsimile, in which electrophotographic techniques are applied.

anti-oxidant (AO-1), 300 parts of bisphenol Z-type polycarbonate "Panlite TS-2050" (manufactured by Teijin Kasei Co., Ltd.) and 50 parts of a hydrophobicity treated silica (number average particle size of 7 μm) were dissolved in 2000 parts of 1,2-dichloroethane, was coated on a charge generating layer by use of a circular slide hopper to form a charge transporting layer having a dry layer thickness of 24 μm, resulting in preparation of a photoreceptor 21. A average surface roughness (Ra) of photoreceptor 21 was 2.15 nm.

Charge Transporting Substance CT-1

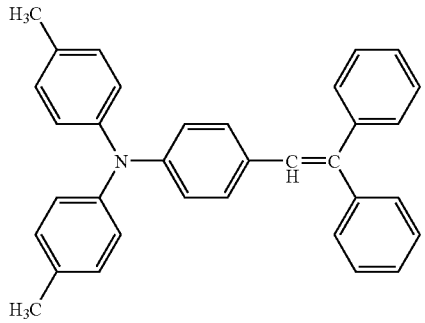

Anti-oxidenat (AO-1)

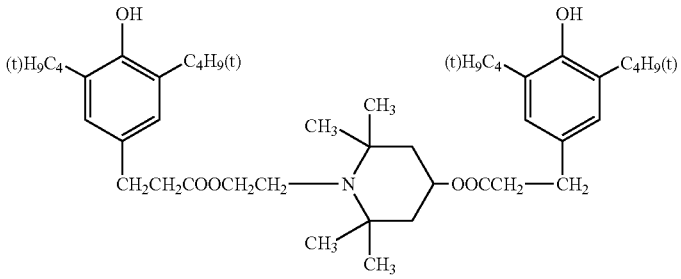

Preparation of a Photoreceptor

Preparation of Photoreceptor 21

An under-coating layer coating composition, in which 20 parts of titanium chelate compound "TC-750" (manufactured by Matsumoto Chemical Industry Co., Ltd.) and 13 parts of silane coupling agent KBM-503 (manufactured by Shin-Etsu Chemical Co., Ltd.) were dissolved in a solvent mixture comprising isopropanol/water=100/3, was immersion coated on a cylindrical aluminum drum, and thermally cured at 150° C. for 30 minutes to provide an under-coating layer having a dry layer thickness of 1.0 μm.

Thereon, a coating composition, in which 6 parts of titanyl phthalocyanine pigment having a Bragg's angle 2θ in X-ray diffraction of 9.5°, 24.1° and 27.2°, 7 parts of silicone resin "KR-5240" (manufactured by Shin-Etsu Chemical Co., Ltd.) and 200 parts of t-butyl acetate were dispersed by use of a sand grinder, was immersion coated to form a charge generating layer having a dry layer thickness of 0.3 μm.

Consequently, a coating composition, in which 200 parts of a charge transporting substance (CT-1), 5 parts of an Preparation of Photoreceptor 22

Photoreceptor 22 was prepared in a similar manner to the preparation of photoreceptor 21, except that hydrophobicity treated silica (a number average particle diameter of 45 nm) was used instead of hydrophobicity treated silica (a number average particle diameter of 15 nm). A average surface roughness (Ra) of photoreceptor 22 was 35.6 nm.

Preparation of Photoreceptor 23

Photoreceptor 23 was prepared in a similar manner to the preparation of photoreceptor 21, except that hydrophobicity treated titanium oxide (a number average particle diameter of 35 nm) was used instead of hydrophobicity treated silica (a number average particle diameter of 15 nm). A average surface roughness (Ra) of photoreceptor 23 was 24.2 nm.

Preparation of Photoreceptor 24

Photoreceptor 24 was prepared in a similar manner to the preparation of photoreceptor 21, except that hydrophobicity treated zirconia (a number average particle diameter of 62 nm) was used instead of hydrophobicity treated silica (a number average particle diameter of 15 nm). A average surface roughness (Ra) of photoreceptor 24 was 48.4 nm.

Preparation of Photoreceptor 25

Photoreceptor 25 was prepared in a similar manner to the preparation of photoreceptor 21, except that hydrophobicity treated alumina (a number average particle diameter of 100 nm) was used instead of hydrophobicity treated silica (a number average particle diameter of 15 nm). A average surface roughness (Ra) of photoreceptor 25 was 72.5 nm.

Preparation of Photoreceptor 26

Photoreceptor 26 was prepared in a similar manner to the preparation of photoreceptor 21, except that fine particles of sintered silica (a number average particle diameter of 0.13 μm) was used instead of hydrophobicity treated silica (a number average particle diameter of 15 nm). A average surface roughness (Ra) of photoreceptor 26 was 96.6 nm.

Preparation of Photoreceptor 27

Photoreceptor 27 was prepared in a similar manner to the preparation of photoreceptor 21, except that fine particles of sintered silica (a number average particle diameter of 0.25 μm) was used instead of hydrophobicity treated silica (a number average particle diameter of 15 nm). A average surface roughness (Ra) of photoreceptor 27 was 112 nm.

Preparation of Photoreceptor 28

Photoreceptor 28 was prepared in a similar manner to the preparation of photoreceptor 21, except that hydrophobicity treated silica (a number average particle diameter of 15 nm) was eliminated. A average surface roughness (Ra) of photoreceptor 28 was 1.2 nm.

A number average particle diameter of such as colloidal silica utilized in the preparation of photoreceptors 21 to 28 is a measured value as a mean diameter in a FERE direction by means of image analysis, with respect to randomly observed 100 particles as a primary particle at a magnification of 10000 times through a transmission type electron-microscope.

Evaluation

A cleaning means shown in FIG. 5 was mounted as a cleaning means for a photoreceptor of a digital color printer provided with an intermediate transfer element shown in FIG. 1, a photoreceptor, surface energy-lowering agents described in Example 1, in addition to Rz of an intermediate transfer element and an intrusion amount of cleaning brush were combined with the digital color printer as shown in Table 6, followed by printing continuously 100,000 sheets of a A4 image having a picture element ratio of 8% under a condition of high temperature and high humidity (30° C., 80% RH), and the results were evaluated. Evaluation items are such as evaluation of hollow characters and scattered characters, unevenness of halftone, evaluation of cleaning property and sharpness evaluation of an image. Evaluation items and criteria will be described below. Further, the evaluation results are shown in Table 2.

Evaluation Items and Evaluation Criteria

Measurement of a contact angle of a photoreceptor and a variation thereof

After finishing 1,000 sheets of evaluation described above, a contact angle of the surface of a photoreceptor against pure water was measured by means of the method described in the description using a contact angle meter (CA-DT•A-type: produced by Kyowa Interface Science Co., Ltd.) under an environment of 30° C. and 80% RH.

Generation of Hollow Characters

Characters were observed under magnification and existence of hollow character generation was observed visually.

A: no significant hollow characters are generated until the finish of 100,000 sheets print, B: no significant hollow characters are generated until the finish of 50,000 sheets print, C: significant hollow characters are generated in a print of less than 50,000 sheets Evaluation of Scattered Characters A 10% screen image was formed in a whole image area in stead of a dot image constituting a character, and toner scatter around a dot was observed through a loupe.

A: minimal toner scatter is observed until the finish of 100,000 sheets print,

B: minimal toner scatter is observed until the finish of 50,000 sheets print,

C: increased toner scatter is observed in a print of less than 50,000 sheets (being problematic in practical use).

Halftone image unevenness: judgment was performed according to a density difference (ΔHD=maximum density−minimum density) of a halftone image (an uniform image having a density of around 0.2) after finishing 100,000 sheets of copy.

A density of copy paper without having been printed (blank paper) was measured at 20 points, as an absolute image density by use of Macbeth reflection densitometer "RD-918" and let the average value be a blank paper density. Next, measurement was carried out, in a similar manner to the above-described halftone image portion, at 20 points as an absolute image density, and let the maximum density minus the minimum density be AHD and evaluation was performed with respect thereto.

A: not more than 0.05 (excellent)

B: not less than 0.05 and less than 0.1 (acceptable in practical use)

C: not less than 0.1 (problematic in practical use)

Evaluation of Cleaning Property

Appearance of toner escape due to friction between a photoreceptor and a cleaning blade, and generation of blade twist (a turning over phenomenon of a blade) were evaluated.

A: no toner escape and blade twist are observed until the finish of 100,000 sheets print, B: No toner escape and blade twist are observed until the finish of 50,000 sheets print, C: toner escape or blade twist is observed at a print of less than 50,000 sheets.

Sharpness of Image

Reproducibility of fine lines and image sharpness were evaluated according to fill-in of characters, by forming an image under an environment of high temperature and ordinary humidity (a temperature of 33° C. and a relative humidity of 50%). Evaluation was performed according to the following criteria, by forming an image of 3-point and 5-point characters.

A: both 3-point and 5-point characters are clear and easily readable,

B: a part of 3-point characters is not readable, but 5-point characters are clear and easily readable, C: 3-point characters are hardly readable, and a part of or all of 5-point characters are unreadable.

Other Evaluation Conditions

Line velocity of image formation L/S: 180 mm/s

Charging conditions of a photoreceptor (60 mm ϕ): An electric potential of a non-image portion was detected by a potential sensor and controlled by means of feed-back, a controllable range thereof being from −500 V to −900 V, and the surface voltage of a photoreceptor when being flush exposed was set to a range of from −50 V to 0 V.

Light source for image exposure: Semiconductor laser (wavelength: 780 nm)

Development conditions: Every developers Y, M, C and K are a two-components developer comprising a toner having a number average particle diameter of 7.5 μm and a carrier (toner density: 5 weight %), and a developing device utilized is also a type corresponding to a two-components developer.

Intermediate transfer element: Seamless and endless belt-form intermediate transfer element 70 was utilized, which was made of a semi-conductive resin having a volume specific resistance of $1\times10^8$ Ω·cm. Two kinds of Rz, of 0.9 μm and of 1.5 μm, were used.

Primary Transfer Conditions

Primary transfer roller (5Y, 5M, 5C and 5K (each has 6.05 mm ϕ) of FIG. 1): a constitution in which elastic rubber is attached on a core metal: a surface specific resistance of $1\times10^6$ Ω, being applied with a transfer potential Conditions for Cleaning of a Photoreceptor Cleaning blade: an urethane rubber blade was in pressing contacted with a photoreceptor by a counter method with respect to a rotation direction of a photoreceptor.

Cleaning brush: made of an electric conductive acrylic resin, having a brush hair density of $3\times10^3/cm^2$: three kinds having intrusion amounts of 0.6, 1.0 and 1.3 mm were utilized.

Secondary transfer roller (5A of FIG. 1): a constitution in which elastic rubber was attached on a core metal: transfer voltage was applied.

Condition for cleaning of an intermediate transfer roller

Cleaning blade: an urethane rubber

TABLE 6

| No. | Photo-receptor No. (Ra: nm) | Surface energy reducing agent (water content: weight %) | *1 | *2 | *3 | *4 | *5 | *6 | Half-tone uneven-ness | *7 | Sharp-ness | Remark |
|---|---|---|---|---|---|---|---|---|---|---|---|---|
| 1 | 4 (48.4) | A (0.05) | 1.5 | 1.0 | 112 | +2 | A | A | A | A | A | Inv. |
| 2 | 4 (48.4) | B (0.1) | 1.5 | 1.0 | 115 | +2 | A | A | A | A | A | Inv. |
| 3 | 4 (48.4) | C (1.0) | 1.5 | 1.0 | 110 | −3 | A | A | A | A | A | Inv. |
| 4 | 4 (48.4) | D (2.5) | 1.5 | 1.0 | 105 | −4 | A | B | A | A | B | Inv. |
| 5 | 4 (48.4) | E (4.5) | 1.5 | 1.0 | 97 | +5 | B | B | A | A | B | Inv. |
| 6 | 4 (48.4) | F (5.5) | 1.5 | 1.0 | 94 | +7 | C | C | B | B | C | Comp. |
| 7 | 1 (2.15) | C (1.0) | 0.9 | 1.0 | 105 | +4 | B | A | A | A | B | Inv. |
| 8 | 2 (35.6) | C (1.0) | 1.5 | 0.6 | 110 | +3 | A | A | A | A | A | Inv. |
| 9 | 3 (24.2) | C (1.0) | 0.09 | 1.3 | 112 | +2 | A | A | A | A | A | Inv. |
| 10 | 5 (72.5) | C (1.0) | 1.5 | 1.3 | 112 | +4 | A | B | A | A | B | Inv. |
| 11 | 6 (96.6) | C (1.0) | 1.5 | 1.0 | 96 | −5 | B | B | A | A | B | Inv. |
| 12 | 7 (112) | C (1.0) | 1.5 | 1.0 | 93 | −7 | C | C | A | A | C | Comp. |
| 13 | 8 (1.2) | C (1.0) | 1.5 | 1.0 | 110 | +7 | B | B | C | A | C | Comp. |
| 14 | 4 (48.4) | None | 1.5 | 1.0 | 86 | +6 | C | C | B | C | C | Cokmp. |

*1: Rz of intermediate transfer Element (μm)
*2: Intrusion amount of cleaning brush (mm)
*3: Average Contact angle of photoreceptor (°)
*4: Variation of cantact angle (°)
*5: Hollow characters
*6: Scattered characters
*7: Cleaning characteristics
Inv.: Invention
Comp.: Comparative Sample Secondary Transfer Conditions Utilizing endless belt-form intermediate transfer element 70 as an intermediate transfer element, back-up roller 74 and secondary transfer roller 5A were arranged so as to sandwich the element, a resistance of a back-up roller being $1\times10^6$ Ω, a resistance of a secondary transfer roller as a secondary transfer means being $1\times10^6$ Ω and being controlled to have a constant electric current (approximately 80 μA).

Fixing was performed by means of a thermal fixing method utilizing a fixing roller provided with a heater being arranged inside thereof.

Distance Y on an intermediate transfer element from the first contact point of an intermediate transfer element with a photoreceptor to the first contact point with the next color photoreceptor was set to 95 mm.

A surrounding length (circumferential length) of driving roller 71, guide rollers 72, 73 and back-up roller 74 was set to 31.67 mm (=95 mm/3), and a surrounding length of tension roller was set to 23.7 mm (=95 mm/4).

Further, a surrounding length of a primary transfer roller was set to 19 mm (=95 mm/5).

It is clear from Table 6 that combinations 1 to 5 and 7 to 11 according to the invention, in which a surface energy-lowering agent was applied and a variation of contact angle of a photoreceptor is reduced within not more than ±5°, have exhibited remarkable improvement in such as hollow characters, scattered characters and sharpness, compared to combinations out of the invention 6 and 12, in which a variation of contact angle is not less than ±5°, and remarkable improvement with respect to halftone unevenness, compared to combination 13. Further, compared to combination 14 in which a surface energy-lowering agent was not applied, improvement in almost all evaluation items has been exhibited.

By utilizing the invention, improvement of toner transfer characteristics of electrophotography adopting an intermediate transfer element can be achieved, and image defects such as hollow characters and scattered characters due to depressed toner transfer can be prevented, in addition that an electrophotographic image forming apparatus having an excellent cleaning property can be provided.

What is claimed is:

1. An image forming method comprising:

developing a latent image on a photoreceptor to form a toner image on the photoreceptor by a developer comprising a toner; and transferring the toner image onto a recording material or an intermediate transfer element by a transfer device, wherein the developing and the transferring are performed while regulating a contact angle of the photoreceptor with water within ±50° of an average contact angle by applying a surface energy-lowering agent on the surface of the photoreceptor, the surface energy-lowering agent comprises a metal salt of a fatty acid, and water content of the surface energy-lowering agent is not more than 5.0 weight % based on the surface energy-lowering agent.

2. The image forming method of claim 1, wherein the toner image on the photoreceptor is transferred onto the intermediate transfer element, and the transferred image on the intermediate transfer element is transferred onto the recording material.

3. The image forming method of claim 1, wherein the average contact angle is from 90 to 120°.

4. The image forming method of claim 1, wherein an average surface roughness (Ra) of the surface of the photoreceptor in a 5 μm square measured by use of an interatomic power microscope is not less than 1.5 nm and not more than 0.1 μm.

5. The image forming method of claim 1, wherein the surface energy-lowering agent is applied by an agent applying device.

6. The image forming method of claim 1, wherein the metal salt of a fatty acid is zinc stearate.

7. The image forming method of claim 1, wherein the surface layer of the photoreceptor contains fine particles having a number average particle diameter of from 5 to 500 nm.

8. The image forming method of claim 1, wherein a shape coefficient of toner particles of the toner is not more than 16% based on a variation coefficient.

9. The image forming method of claim 1, wherein number ratio of toner particles of the toner having a shape coefficient of 1.2 to 1.6 and is at least 65 percent.

10. The image forming method of claim 1, wherein number ratio of toner particles having no corners is 50 percent or more.

11. The image forming method of claim 1, wherein the sum M of a relative frequency of the toner particles included in the highest frequency class ml and a relative frequency of the toner particles included the next high frequency class m2 is not less than 70% in a histogram showing a particle diameter distribution in number classified into plural classes every 0.23 of natural logarithm in D graduated on the horizontal axis of the histogram, where D is the diameter of the toner particle in μm.

12. The image forming method of claim 1, wherein a toner has a coefficient of number variation of not more than 27%, and the surface energy-lowering agent has a water content of not more than 5 weight % onto the surface of the photoreceptor.

13. The image forming method of claim 1, wherein the toner is a polymerized toner.

14. The image forming method of claim 1, wherein a number average particle diameter of the toner is from 3.0 to 8.5 μm.

15. The image forming method of claim 1, wherein ten-point surface roughness (Rz) of the photoreceptor is from 0.05 to 4.0 μm.

16. The image forming method of claim 1, wherein a surface layer of a photoreceptor contains fine particles having a number average particle diameter of from 5 nm to 8 μm.

17. The image forming method of claim 1, wherein the water content is 0.05 to 3.0 weight %.

18. An image forming method comprising:

developing a latent image on a photoreceptor to form a toner image on the photoreceptor by a developer comprising a toner; and transferring the toner image onto a recording material or an intermediate transfer element by a transfer device, wherein the developing and the transferring are performed while regulating a contact angle of the photoreceptor with water within ±5° of an average contact angle by applying a surface energy-lowering agent on the surface of the photoreceptor through a brush roll, the surface energy-lowering agent comprises a metal salt of a fatty acid, and water content of the surface energy-lowering agent is not more than 5.0 weight % based on the surface energy-lowering agent, the brush roll rotates so that portion contact to the photoreceptor moves in the same direction as the surface of the photoreceptor and a ratio of the surface velocity of the brush roll to that of the photoreceptor is between 1.1 and 2.

19. The image forming method of claim 18, wherein the metal salt of a fatty acid is zinc stearate.

* * * * *